US008662178B2

(12) United States Patent
Norrid et al.

(10) Patent No.: US 8,662,178 B2
(45) Date of Patent: Mar. 4, 2014

(54) RESPONSIVELY ACTIVATED WELLBORE STIMULATION ASSEMBLIES AND METHODS OF USING THE SAME

(75) Inventors: William Mark Norrid, Westminster, CO (US); Benjamin Edward Deyo, Spring, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 216 days.

(21) Appl. No.: 13/248,145

(22) Filed: Sep. 29, 2011

(65) Prior Publication Data

US 2013/0081817 A1 Apr. 4, 2013

(51) Int. Cl.
*E21B 34/14* (2006.01)
*E21B 43/16* (2006.01)

(52) U.S. Cl.
USPC ..... 166/318; 166/305.1; 166/312

(58) Field of Classification Search
USPC ..... 166/318, 311, 312, 305.1
See application file for complete search history.

(56) References Cited

U.S. PATENT DOCUMENTS

| | | | |
|---|---|---|---|
| 2,201,290 | A | 5/1940 | Greene |
| 2,493,650 | A | 1/1950 | Baker et al. |
| 2,537,066 | A | 1/1951 | Lewis |
| 2,627,314 | A | 2/1953 | Baker et al. |
| 2,913,051 | A | 11/1959 | Lister |
| 3,054,415 | A | 9/1962 | Baker et al. |
| 3,057,405 | A | 10/1962 | Mallinger |
| 3,151,681 | A | 10/1964 | Cochran |
| 3,216,497 | A | 11/1965 | Howard et al. |
| 3,363,696 | A | 1/1968 | Berryman |
| 3,434,537 | A | 3/1969 | Zandmer |
| 3,768,556 | A | 10/1973 | Baker |
| 3,850,238 | A | 11/1974 | Hill |
| 4,081,990 | A | 4/1978 | Chatagnier |

(Continued)

FOREIGN PATENT DOCUMENTS

| | | | |
|---|---|---|---|
| EP | 2216500 | A2 | 8/2010 |
| GB | 2323871 | A | 10/1998 |

(Continued)

OTHER PUBLICATIONS

Foreign communication from a related counterpart application—International Search Report and Written Opinion, PCT/GB2012/000139, Dec. 19, 2012, 11 pages.

(Continued)

*Primary Examiner* — Giovanna Wright
(74) *Attorney, Agent, or Firm* — John Wustenberg; Conley Rose, P.C.

(57) ABSTRACT

A wellbore servicing apparatus comprising a housing substantially defining an axial flowbore and comprising one or more ports, an expandable seat, and a sliding sleeve slidably fitted within the housing, the sliding sleeve being transitional from a first position to a second position and from the second position to a third position, wherein, in the first position, the sliding sleeve does not permit fluid communication via the one or more ports and the expandable seat is retained in a narrower, non-expanded conformation, wherein, in the second position, the sliding sleeve permits fluid communication via the one or more ports and the expandable seat is retained in a narrower, non-expanded conformation, and wherein, in the third position, the sliding sleeve does not permit fluid communication via the one or more ports and the expandable seat is allowed to expand into a wider, expanded conformation.

25 Claims, 4 Drawing Sheets

(56) References Cited

U.S. PATENT DOCUMENTS 4,105,069 A 8/1978 Baker
4,109,725 A 8/1978 Williamson et al.
4,150,994 A 4/1979 Maternaghan
4,417,622 A 11/1983 Hyde
4,469,136 A 9/1984 Watkins
4,673,039 A 6/1987 Mohaupt
4,714,117 A 12/1987 Dech
4,893,678 A 1/1990 Stokley et al.
5,125,582 A 6/1992 Surjaatmadja et al.
5,127,472 A 7/1992 Watson et al.
5,156,220 A 10/1992 Forehand et al.
5,180,016 A 1/1993 Ross et al.
5,323,856 A 6/1994 Davis et al.
5,325,917 A 7/1994 Szarka
5,325,923 A 7/1994 Surjaatmadja et al.
5,361,856 A 11/1994 Surjaatmadja et al.
5,366,015 A 11/1994 Surjaatmadja et al.
5,375,662 A 12/1994 Echols, III et al.
5,381,862 A 1/1995 Szarka et al.
5,396,957 A 3/1995 Surjaatmadja et al.
5,425,424 A 6/1995 Reinhardt et al.
5,484,016 A 1/1996 Surjaatmadja et al.
5,494,103 A 2/1996 Surjaatmadja et al.
5,494,107 A 2/1996 Bode
5,499,678 A 3/1996 Surjaatmadja et al.
5,499,687 A 3/1996 Lee
5,533,571 A 7/1996 Surjaatmadja et al.
5,765,642 A 6/1998 Surjaatmadja
5,826,661 A 10/1998 Parker et al.
5,865,252 A 2/1999 Van Petegem et al.
5,865,254 A 2/1999 Huber et al.
5,944,105 A 8/1999 Nguyen
5,947,205 A 9/1999 Shy
5,960,881 A 10/1999 Allamon et al.
6,006,838 A 12/1999 Whiteley et al.
6,116,343 A 9/2000 Van Petegem et al.
6,119,783 A 9/2000 Parker et al.
6,152,232 A 11/2000 Webb et al.
6,167,974 B1 1/2001 Webb
6,189,618 B1 2/2001 Beeman et al.
6,216,785 B1 4/2001 Achee, Jr. et al.
6,230,811 B1 5/2001 Ringgenberg et al.
6,244,342 B1 6/2001 Sullaway et al.
6,253,861 B1 7/2001 Carmichael et al.
6,286,599 B1 9/2001 Surjaatmadja et al.
6,318,470 B1 11/2001 Chang et al.
6,336,502 B1 1/2002 Surjaatmadja et al.
6,343,658 B2 2/2002 Webb
6,422,317 B1 7/2002 Williamson, Jr.
6,520,257 B2 2/2003 Allamon et al.
6,543,538 B2 4/2003 Tolman et al.
6,571,875 B2 6/2003 Bissonnette et al.
6,634,428 B2 10/2003 Krauss et al.
6,662,874 B2 12/2003 Surjaatmadja et al.
6,662,877 B2 12/2003 Patel
6,719,054 B2 4/2004 Cheng et al.
6,722,427 B2 4/2004 Gano et al.
6,725,933 B2 4/2004 Middaugh et al.
6,769,490 B2 8/2004 Allamon et al.
6,776,238 B2 8/2004 Dusterhoft et al.
6,779,607 B2 8/2004 Middaugh et al.
6,789,619 B2 9/2004 Carlson et al.
6,802,374 B2 10/2004 Edgar et al.
6,907,936 B2 6/2005 Fehr et al.
6,923,255 B2 8/2005 Lee
6,938,690 B2 9/2005 Surjaatmadja
6,997,252 B2 2/2006 Porter et al.
6,997,263 B2 2/2006 Campbell et al.
7,013,971 B2 3/2006 Griffith et al.
7,021,384 B2 4/2006 Themig
7,021,389 B2 4/2006 Bishop et al.
7,055,598 B2 6/2006 Ross et al.
7,066,265 B2 6/2006 Surjaatmadja
7,090,153 B2 8/2006 King et al.
7,096,954 B2 8/2006 Weng et al.
7,108,067 B2 9/2006 Themig et al.
7,134,505 B2 11/2006 Fehr et al.
7,159,660 B2 1/2007 Justus
7,168,493 B2 1/2007 Eddison
7,195,067 B2 3/2007 Manke et al.
7,225,869 B2 6/2007 Willett et al.
7,228,908 B2 6/2007 East, Jr. et al.
7,234,529 B2 6/2007 Surjaatmadja
7,237,612 B2 7/2007 Surjaatmadja et al.
7,243,723 B2 7/2007 Surjaatmadja et al.
7,252,147 B2 8/2007 Badalamenti et al.
7,252,152 B2 8/2007 LoGiudice et al.
7,273,099 B2 9/2007 East, Jr. et al.
7,278,486 B2 10/2007 Alba et al.
7,287,592 B2 10/2007 Surjaatmadja et al.
7,290,611 B2 11/2007 Badalamenti et al.
7,296,625 B2 11/2007 East, Jr.
7,303,008 B2 12/2007 Badalamenti et al.
7,306,043 B2 12/2007 Toekje et al.
7,322,412 B2 1/2008 Badalamenti et al.
7,322,417 B2 1/2008 Rytlewski et al.
7,325,617 B2 2/2008 Murray
7,337,844 B2 3/2008 Surjaatmadja et al.
7,337,847 B2 3/2008 McGarian et al.
7,343,975 B2 3/2008 Surjaatmadja et al.
7,353,878 B2 4/2008 Themig
7,353,879 B2 4/2008 Todd et al.
7,377,321 B2 5/2008 Rytlewski
7,377,322 B2 5/2008 Hofman
7,385,523 B2 6/2008 Thomeer et al.
7,387,165 B2 6/2008 Lopez de Cardenas et al.
7,398,825 B2 7/2008 Nguyen et al.
7,416,029 B2 8/2008 Telfer et al.
7,419,002 B2 9/2008 Dybevik et al.
7,422,060 B2 9/2008 Hammami et al.
7,431,090 B2 10/2008 Surjaatmadja et al.
7,431,091 B2 10/2008 Themig et al.
7,464,764 B2 12/2008 Xu
7,478,676 B2 1/2009 East, Jr. et al.
7,503,390 B2 3/2009 Gomez
7,503,398 B2 3/2009 LoGiudice et al.
7,506,689 B2 3/2009 Surjaatmadja et al.
7,510,010 B2 3/2009 Williamson
7,510,017 B2 3/2009 Howell et al.
7,520,327 B2 4/2009 Surjaatmadja
7,527,103 B2 5/2009 Huang et al.
7,571,766 B2 8/2009 Pauls et al.
7,575,062 B2 8/2009 East, Jr.
7,617,871 B2 11/2009 Surjaatmadja et al.
7,628,213 B2 12/2009 Telfer
7,637,323 B2 12/2009 Schasteen et al.
7,644,772 B2 1/2010 Avant et al.
7,661,478 B2 2/2010 Palmer et al.
7,665,545 B2 2/2010 Telfer
7,673,673 B2 3/2010 Surjaatmadja et al.
7,673,677 B2 3/2010 King et al.
7,681,645 B2 3/2010 McMillin et al.
7,703,510 B2 4/2010 Xu
7,735,559 B2 6/2010 Malone
7,740,072 B2 6/2010 Surjaatmadja
7,740,079 B2 6/2010 Clayton et al.
7,748,460 B2 7/2010 Themig et al.
7,775,285 B2 8/2010 Surjaatmadja et al.
7,779,906 B2 8/2010 Porter et al.
7,849,924 B2 12/2010 Surjaatmadja et al.
7,861,788 B2 1/2011 Tips et al.
7,866,396 B2 1/2011 Rytlewski
7,866,402 B2 1/2011 Williamson, Jr.
7,866,408 B2 1/2011 Allison et al.
7,870,907 B2 1/2011 Lembcke et al.
7,878,255 B2 2/2011 Howell et al.
7,909,108 B2 3/2011 Swor et al.
7,926,571 B2 4/2011 Hofman
7,934,559 B2 * 5/2011 Posevina et al. ..... 166/318
7,946,340 B2 5/2011 Surjaatmadja et al.
7,963,331 B2 6/2011 Surjaatmadja et al.
8,162,050 B2 4/2012 Roddy et al.
8,191,625 B2 6/2012 Porter et al.
8,215,411 B2 7/2012 Flores et al.

(56) References Cited

U.S. PATENT DOCUMENTS

| | | | | |
|---|---|---|---|---|
| 8,245,788 | B2 | 8/2012 | Garcia et al. | |
| 8,276,675 | B2 | 10/2012 | Williamson et al. | |
| 8,291,980 | B2 | 10/2012 | Fay | |
| 8,316,951 | B2 | 11/2012 | Fay et al. | |
| 8,365,824 | B2 | 2/2013 | Phillips | |
| 2003/0029611 | A1 | 2/2003 | Owens | |
| 2006/0086507 | A1 | 4/2006 | Surjaatmadja et al. | |
| 2006/0157257 | A1 | 7/2006 | Ross et al. | |
| 2007/0102156 | A1 | 5/2007 | Nguyen et al. | |
| 2007/0261851 | A1 | 11/2007 | Surjaatmadja | |
| 2007/0272411 | A1 | 11/2007 | Lopez de Cardenas et al. | |
| 2007/0284114 | A1 | 12/2007 | Swor et al. | |
| 2008/0000637 | A1 | 1/2008 | McDaniel et al. | |
| 2008/0060810 | A9 | 3/2008 | Nguyen et al. | |
| 2008/0135248 | A1 | 6/2008 | Talley et al. | |
| 2008/0190620 | A1* | 8/2008 | Posevina et al. | 166/332.1 |
| 2008/0202764 | A1 | 8/2008 | Clayton et al. | |
| 2008/0264641 | A1 | 10/2008 | Slabaugh et al. | |
| 2009/0308588 | A1 | 12/2009 | Howell et al. | |
| 2010/0000727 | A1 | 1/2010 | Webb et al. | |
| 2010/0044041 | A1 | 2/2010 | Smith et al. | |
| 2010/0200243 | A1 | 8/2010 | Purkis | |
| 2011/0036590 | A1 | 2/2011 | Williamson et al. | |
| 2011/0100643 | A1 | 5/2011 | Themig et al. | |
| 2011/0108272 | A1 | 5/2011 | Watson et al. | |
| 2011/0192607 | A1 | 8/2011 | Hofman et al. | |
| 2012/0061105 | A1 | 3/2012 | Neer et al. | |
| 2012/0111574 | A1 | 5/2012 | Desranleau et al. | |
| 2012/0160515 | A1 | 6/2012 | Braekke et al. | |
| 2013/0048298 | A1 | 2/2013 | Merron et al. | |

FOREIGN PATENT DOCUMENTS

| | | | |
|---|---|---|---|
| GB | 2415213 | B | 1/2009 |
| WO | 2004088091 | A1 | 10/2004 |
| WO | 2008070051 | A2 | 6/2008 |
| WO | 2008070051 | A3 | 6/2008 |
| WO | 2008070051 | B1 | 6/2008 |
| WO | 2008093047 | A1 | 8/2008 |
| WO | 2009029437 | A1 | 3/2009 |
| WO | 2009132462 | A1 | 11/2009 |
| WO | 2010127457 | A1 | 11/2010 |
| WO | 2013048696 | A2 | 4/2013 |

OTHER PUBLICATIONS

Foreign communication from a related counterpart application—International Search Report and Written Opinion, PCT/ US2012/054161, Feb. 8, 2013, 11 pages.

Office Action dated Mar. 28, 2012 (39 pages), U.S. Appl. No. 12/617,405, filed Nov. 12, 2009.

Office Action dated Apr. 4, 2012 (21 pages), U.S. Appl. No. 12/539,392, filed Aug. 11, 2009.

Patent application entitled "Delayed activation activatable stimulation assembly," by Matthew James Merron, filed Apr. 30, 2012 as U.S. Appl. No. 13/460,453.

Office Action dated May 8, 2013 (51 pages), U.S. Appl. No. 13/025,039, filed Feb. 10, 2011.

Foreign communication from a related counterpart application—International Search Report and Written Opinion, PCT/GB2012/000140, May 30, 2012, 11 pages.

Patent application entitled "System and Method for Servicing a Wellbore," by Adam Kent Neer, filed Jun. 29, 2012 as U.S. Appl. No. 13/538,911.

Notice of Allowance dated Jul. 9, 2012 (11 pages), U.S. Appl. No. 12/617,405, filed Nov. 12, 2009.

Notice of Allowance dated Jul. 25, 2012 (9 pages), U.S. Appl. No. 12/539,392, filed on Aug. 11, 2009.

Supplemental Notice of Allowability dated Aug. 22, 2012 (6 pages), U.S. Appl. No. 12/539,392, filed on Aug. 11, 2009.

Foreign communication from a related counterpart application—International Search Report and Written Opinion, PCT/GB2008/002646, Dec. 11, 2008, 8 pages.

Foreign Communication from a related counterpart application—International Search Report and Written Opinion, PCT/GB2007/004628, Feb. 26, 2008, 8 pages.

Foreign commuunication from a related counterpart application—International Search Report and Written Opinion, PCT/GB2009/001505, Feb. 8, 2011, 8 pages.

Foreign communication from a related counterpart application—International Search Report and Written Opinion, PCT/GB2009/002693, Mar. 2, 2010, 8 pages.

Foreign communication from a related counterpart application—International Search Report and Written Opinion, PCT/GB2010/001524, Apr. 13, 2011, 11 pages.

Foreign communication from a related counterpart application—International Search Report and Written Opinion, PCT/GB2010/002090, Aug. 12, 2011, 11 pages.

Halliburton brochure entitled "Delta Stim® Completion Service," Sep. 2008, 4 pages, Halliburton.

Halliburton brochure entitled "Delta Stim™ Sleeve," Mar. 2007, 2 pages, Halliburton.

Halliburton brochure entitled "Swellpacker® cable system," Aug. 2008, 2 pages, Halliburton.

Halliburton brochure entitled "RapidFrac™ System," Mar. 2011, 3 pages.

Halliburton brochure entitled "sFrac™ Valve," Jun. 2010, 3 pages, Halliburton.

Halliburton Marketing Data Sheet, Sand Control, EquiFlow™ Inflow Control Devices, HO5600, Jan. 2008, pp. 1-2.

The Lee Company brochure entitled "Meet the EFS family," http://www.theleeco.com/EFSWEB2.NSF/Products! OpenPage, Apr. 21, 2009, 1 page.

The Lee Company brochure entitled "Meet the precision microhydraulics family," http://www.theleeco.com/LEEWEB2.NSF/AeroStart!OpenPage, Apr. 21, 2009, 2 pages.

Lohm calculator for gas flow, http://www.theleeco.com/EFSWEB2.NSF/airlohms.htm, Apr. 21, 2009, 2 pages, courtesy of the Lee Company.

Lohm calculator for liquid flow, http://www.theleeco.com/EFSWEB2.NSF/flowcalc.htm, Apr. 21, 2009, 2 pages, courtesy of The Lee Company.

Office Action (Final) dated Sep. 15, 2009 (12 pages), U.S. Appl. No. 11/609,128, filed on Dec. 11, 2006.

Office Action dated Feb. 18, 2009 (18 pages), U.S. Appl. No. 11/609,128, filed on Dec. 11, 2006.

Office Action dated Jun. 24, 2010 (13 pages), U.S. Appl. No. 12/139,604, filed on Jun. 16, 2008.

Office Action dated Dec. 22, 2009 (18 pages), U.S. Appl. No. 12/139,604, filed on Jun. 16, 2008.

Office Action (Final) dated Aug. 12, 2011 (12 pages), U.S. Appl. No. 12/166,257, filed Jul. 1, 2008.

Office Action dated Mar. 31, 2011 (19 pages), U.S. Appl. No. 12/166,257, filed Jul. 1, 2008.

Office Action dated Aug. 9, 2011 (24 pages), U.S. Appl. No. 12/539,392, filed on Aug. 11, 2009.

Packers Plus brochure entitled "Achieve immediate production; StackFRAC ® HD," Mar. 11, 2011, 4 pages.

Patent application entitled "A Method for individually servicing a plurality of zones of a subterranean formation," by Matthew Todd Howell, filed Feb. 10, 2011 as U.S. Appl. No. 13/025,039.

Patent application entitled "System and method for servicing a wellbore," by Jesse Cale Porter, et al., filed Feb. 10, 2011 as U.S. Appl. No. 13/025,041.

Patent application entitled "System and method for servicing a wellbore," by Jesse Cale Porter, et al., filed Jun. 2, 2011 as U.S. Appl. No. 13/151,457.

Patent application entitled "System and method for servicing a wellbore," by Matthew James Merron, et al., filed Aug. 23, 2011 as U.S. Appl. No. 13/215,553.

Packers Plus® Case Study entitled "Packers Plus launches the StackFRAC® HD "High Density" Multi-Stage Fracturing System to fulfill operator demand for more stimulation stages to increase production," 1 page.

(56) References Cited

OTHER PUBLICATIONS

Packers Plus brochure entitled "High Density Multi-Stage Fracturing System; StackFRAC® HD," Apr. 20, 2010, 2 pages.
Patent application entitled "Responsively activated wellbore stimulation assemblies and methods of using the same," by Brock William Miller, filed Jun. 8, 2011 as U.S. Appl. No. 13/156,155.
Foreign communication from a related counterpart application—International Search Report and Written Opinion, PCT/GB2012/000141, Dec. 20, 2012, 11 pages.
Office Action dated Jun. 18, 2013 (41 pages), U.S. Appl. No. 13/025,041, filed Feb. 10, 2011.
Office Action dated Jun. 18, 2013 (40 pages), U.S. Appl. No. 13/151,457, filed Jun. 2, 2011.

* cited by examiner

RESPONSIVELY ACTIVATED WELLBORE STIMULATION ASSEMBLIES AND METHODS OF USING THE SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

In some wellbores, it may be desirable to individually and selectively create multiple fractures along a wellbore at a distance apart from each other, creating multiple "pay zones." The multiple fractures should have adequate conductivity, so that the greatest possible quantity of hydrocarbons in an oil and gas reservoir can be produced from the wellbore. Some pay zones may extend a substantial distance along the length of a wellbore. In order to adequately induce the formation of fractures within such zones, it may be advantageous to introduce a stimulation fluid via multiple stimulation assemblies positioned within a wellbore adjacent to multiple zones. To accomplish this, it is necessary to configure multiple stimulation assemblies for the communication of fluid via those stimulation assemblies. Thus, there is an ongoing need to develop new methods and apparatuses to enhance hydrocarbon production.

SUMMARY

Disclosed herein is a wellbore servicing apparatus comprising a housing substantially defining an axial flowbore and comprising one or more ports, an expandable seat, and a sliding sleeve slidably fitted within the housing, the sliding sleeve being transitional from a first position relative to the housing to a second position relative to the housing and from the second position to a third position relative to the housing, wherein, in the first position, the sliding sleeve does not permit fluid communication from the axial flowbore to an exterior of the housing via the one or more ports and the expandable seat is retained in a narrower, non-expanded conformation, wherein, in the second position, the sliding sleeve permits fluid communication from the axial flowbore to the exterior of the housing via the one or more ports and the expandable seat is retained in a narrower, non-expanded conformation, and wherein, in the third position, the sliding sleeve does not permit fluid communication from the axial flowbore to the exterior of the housing via the one or more ports and the expandable seat is allowed to expand into a wider, expanded conformation.

Also disclosed herein is a wellbore servicing system comprising a casing string having incorporated therein a first wellbore servicing apparatus and a second wellbore servicing apparatus, each of the first wellbore servicing apparatus and the second wellbore servicing apparatus comprising a housing substantially defining an axial flowbore and comprising a one or more ports, a expandable seat, and a sliding sleeve slidably fitted within the housing, the sliding sleeve being transitional from a first position relative to the housing to a second position relative to the housing and from the second position to a third position relative to the housing, wherein, in the first position, the sliding sleeve does not permit fluid communication from the axial flowbore to an exterior of the housing via the one or more ports and the expandable seat is retained in a narrower, non-expanded conformation, wherein, in the second position, the sliding sleeve permits fluid communication from the axial flowbore to the exterior of the housing via the one or more ports and the expandable seat is retained in a narrower, non-expanded conformation, and wherein, in the third position, the sliding sleeve does not permit fluid communication from the axial flowbore to the exterior of the housing via the one or more ports and the expandable seat is allowed to expand into a wider, expanded conformation.

Further disclosed herein is a process for servicing a wellbore comprising positioning a casing string within the wellbore, the casing string having incorporated therein a first wellbore servicing apparatus and a second wellbore servicing apparatus, wherein the first wellbore servicing apparatus is up-hole relative to the second wellbore servicing apparatus, each of the first wellbore servicing apparatus and the second wellbore servicing apparatus comprising a housing substantially defining an axial flowbore, and one or more ports, each of the first wellbore servicing apparatus and the second wellbore servicing apparatus being transitional from a first mode to a second mode and from the second mode to a third mode, transitioning the first wellbore servicing apparatus from the first mode to the second mode, wherein transitioning the first wellbore servicing apparatus from the first mode to the second mode comprises introducing an obturating member into the casing string and forward-circulating the obturating member to engage and be retained by a seat within the first wellbore servicing apparatus, communicating a wellbore servicing fluid from the axial flowbore of the first wellbore servicing apparatus to an exterior of the housing of the first wellbore servicing apparatus via the one or more ports of the first wellbore servicing apparatus, wherein the wellbore servicing fluid is not communicated via the one or more ports of the second wellbore servicing apparatus, transitioning the second wellbore servicing apparatus from the first mode to the second mode, wherein transitioning the second wellbore servicing apparatus from the first mode to the second mode comprises forward-circulating the obturating member to engage a seat within the second wellbore servicing apparatus, communicating the wellbore servicing fluid from the axial flowbore of the second wellbore servicing apparatus to an exterior of the housing of the second wellbore servicing apparatus via the one or more ports of the second wellbore servicing apparatus, wherein the wellbore servicing fluid is not communicated via the one or more ports of the first wellbore servicing apparatus.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
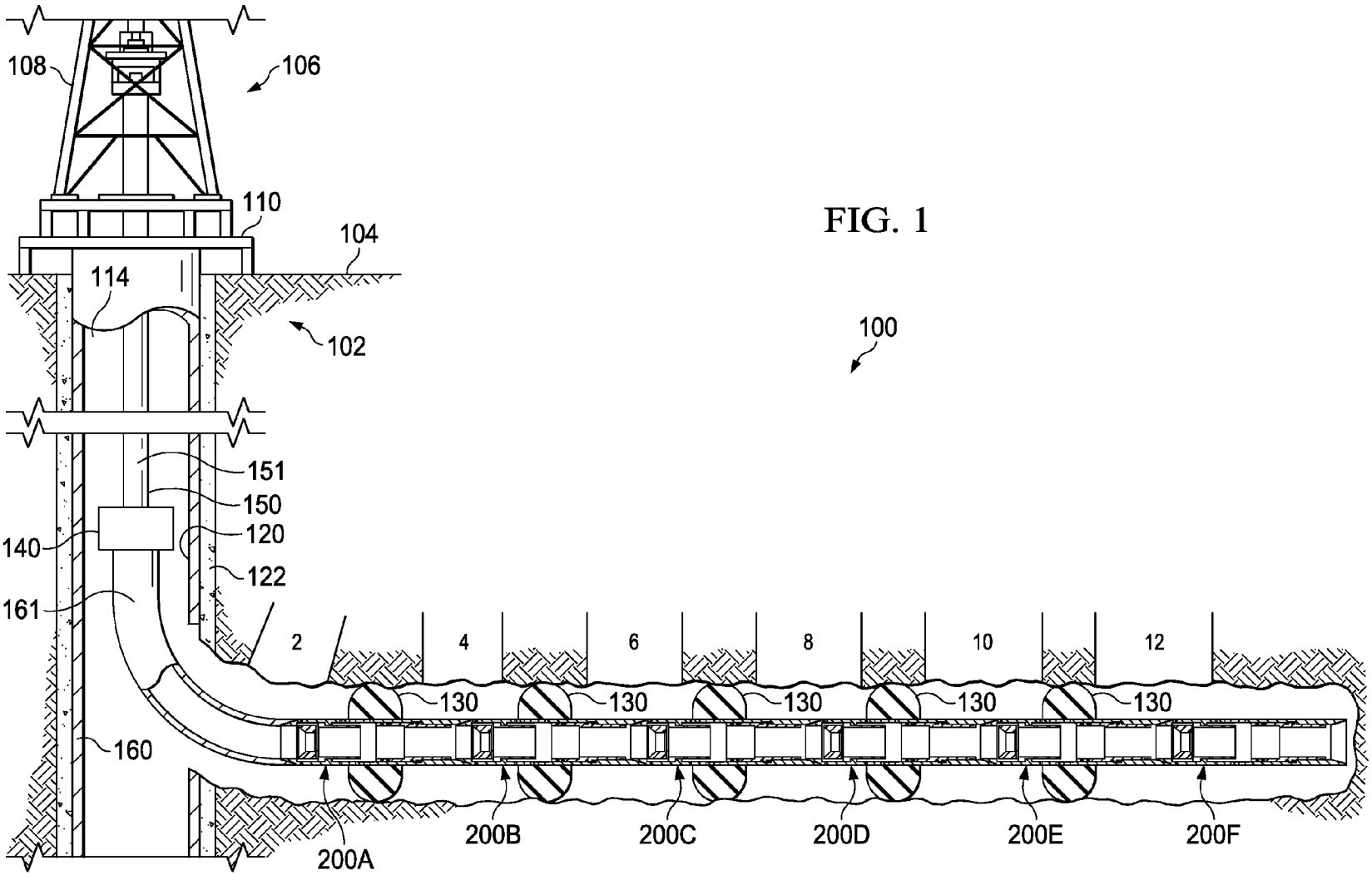
FIG. 1 is partial cut-away view of an embodiment of an environment in which at least one activatable stimulation assembly (ASA) may be employed.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing apparatuses, systems, and methods of using the same. Particularly, disclosed herein are one or more embodiments of a wellbore servicing system comprising one or more activatable stimulation assemblies (ASAs), configured for selective activation in the performance of a wellbore servicing operation.

Referring to FIG. 1, an embodiment of an operating environment in which such a wellbore servicing apparatus and/or system may be employed is illustrated. It is noted that although some of the figures may exemplify horizontal or vertical wellbores, the principles of the apparatuses, systems, and methods disclosed may be similarly applicable to horizontal wellbore configurations, conventional vertical wellbore configurations, and combinations thereof. Therefore, the horizontal or vertical nature of any figure is not to be construed as limiting the wellbore to any particular configuration.

As depicted in FIG. 1, the operating environment generally comprises a wellbore 114 that penetrates a subterranean formation 102 comprising a plurality of formation zones 2, 4, 6, 8, 10, and 12 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig comprises a derrick with a rig floor through which a work string 150 (e.g., a drill string, a tool string, a segmented tubing string, a jointed tubing string, or any other suitable conveyance, or combinations thereof) generally defining an axial flowbore 151 may be positioned within or partially within the wellbore 114. In an embodiment, the work string 150 may comprise two or more concentrically positioned strings of pipe or tubing (e.g., a first work string may be positioned within a second work string). The drilling or servicing rig may be conventional and may comprise a motor driven winch and other associated equipment for lowering the work string 150 into the wellbore 114. Alternatively, a mobile workover rig, a wellbore servicing unit (e.g., coiled tubing units), or the like may be used to lower the work string 150 into the wellbore 114.

The wellbore 114 may extend substantially vertically away from the earth's surface over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved and such wellbore may be cased, uncased, or combinations thereof.

In an embodiment, the wellbore 114 may be partially cased with a first casing string 120 and partially uncased. The first casing string 120 may be secured into position within the wellbore 114 (e.g., a vertical wellbore portion) in a conventional manner with cement 122, alternatively, the first casing string 120 may be partially cemented within the wellbore 120, alternatively, the first casing string may be uncemented. In an alternative embodiment, a portion of the wellbore 114 may remain uncemented, but may employ one or more packers (e.g., Swellpackers™, commercially available from Halliburton Energy Services, Inc.) to isolate two or more adjacent portions or zones within the wellbore 114.

In the embodiment of FIG. 1, a second casing string 160 (hereinafter, casing 160) generally defining an axial flowbore 161 may be positioned within a portion of the wellbore 114. The casing 160 may be lowered into the wellbore 114 suspended from the work string 150. In an embodiment, the casing 160 may be suspended from the work string 150 by a liner hanger 140 or the like. The liner hanger 140 may comprise any suitable type or configuration of liner hanger, as will be appreciated by one of skill in the art with the aid of this disclosure. Like the first casing string 120, the second casing string 160 may be secured into position within the wellbore 114 via cement, packers, or combinations thereof. In an embodiment, after the second casing string 160 has been positioned and, optionally, secured within the wellbore 114 or a portion thereof, the second casing string 160 may be disengaged from the work string 150 and/or the liner hanger 140 and the work string 150 and/or liner hanger 140 may be removed from the wellbore 114. In an alternative embodiment, a wellbore like wellbore 114 may comprise only a single casing string like casing string(s) 120 and/or 160.

Referring to FIG. 1, a wellbore servicing system 100 is illustrated. In the embodiment of FIG. 1, the wellbore servicing system 100 comprises first, second, third, fourth, fifth, and sixth ASAs 200*a*-200*f*, respectively, incorporated within the second casing string 160 and positioned proximate and/or substantially adjacent to subterranean formation zones (or "pay zones") 2, 4, 6, 8, 10, and 12. Although the embodiment of FIG. 1 illustrates six ASAs, one of skill in the art viewing this disclosure will appreciate that any suitable number of ASAs may be similarly incorporated within a casing such as casing 160, for example, 2, 3, 4, 5, 6, 7, 8, 9, 10, etc. ASAs. Additionally, although the embodiment of FIG. 1 illustrates the wellbore servicing system 100 incorporated within the second casing 160, a similar wellbore servicing system may be similarly incorporated within another casing string (e.g., the first casing string 150). In the embodiment of FIG. 1, a single ASA is located and/or positioned substantially adjacent to a each zone (e.g., zones 2, 4, 6, 8, 10, and 12); alternatively, two or more ASAs may be positioned adjacent to a given zone, alternatively, a given single ASA may be positioned adjacent to two or more zones.

In the embodiment of FIG. 1, the wellbore servicing system 100 further comprises a plurality of wellbore isolation devices 130. In the embodiment of FIG. 1, the wellbore isolation devices 130 are positioned between adjacent ASAs 200*a*-200*f* so as to isolate the various formation zones 2, 4, 6, 8, 10, and/or 12. Alternatively, two or more adjacent formation zones may remain unisolated. Suitable wellbore isolation devices are generally known to those of skill in the art and include but are not limited to packers, such as mechanical packers and swellable packers (e.g., Swellpackers™, commercially available from Halliburton Energy Services, Inc.), sand plugs, sealant compositions such as cement, or combinations thereof.

In one or more of the embodiments disclosed herein, the ASAs (cumulatively and non-specifically referred to as ASA 200) may be transitionable from a "first" mode or configuration to a "second" mode or configuration and from the second mode or configuration to a "third" mode or configuration. In an additional embodiment, the ASA may be transitionable from the third mode or configuration to a "fourth" mode or configuration. In another additional embodiment, the ASA may be transitionable from the third mode and/or the fourth mode to a "fifth" mode or configuration.

Figure 2A:
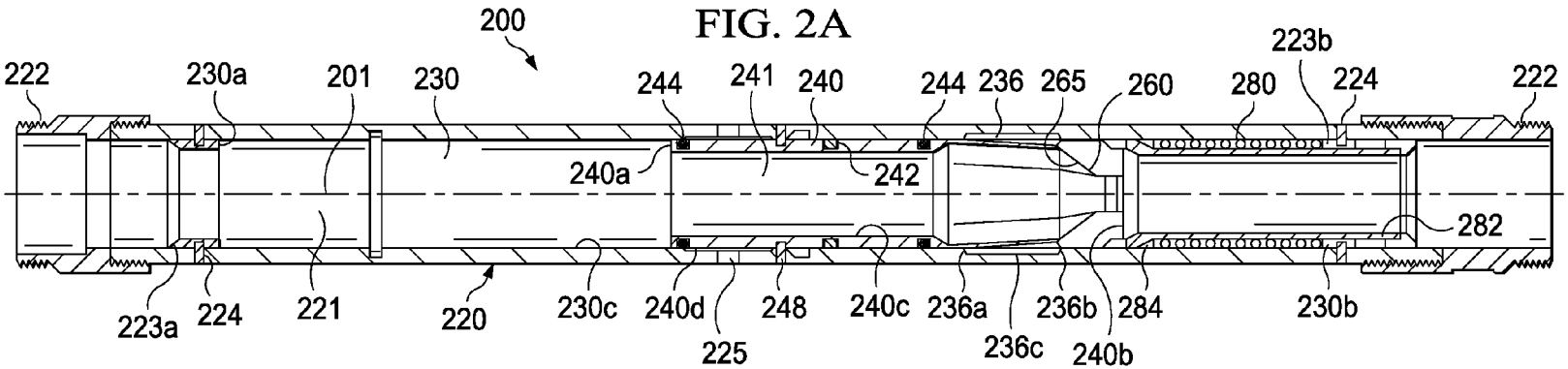
FIG. 2A is a cross-sectional view of an embodiment of an ASA in a first, installation configuration.

Referring to FIG. 2A, an embodiment of an ASA 200 is illustrated in the first mode or configuration. In an embodiment, when the ASA 200 is in the first mode or configuration, also referred to as a run-in or installation mode, the ASA 200 will not provide a route of fluid communication via ports 225 from the flowbore 161 of the casing 160 to the proximate and/or substantially adjacent zone of the subterranean formation 102 and the expandable seat 260 will be retained in a narrower, non-expanded conformation, as will be described herein.

Figure 2B:
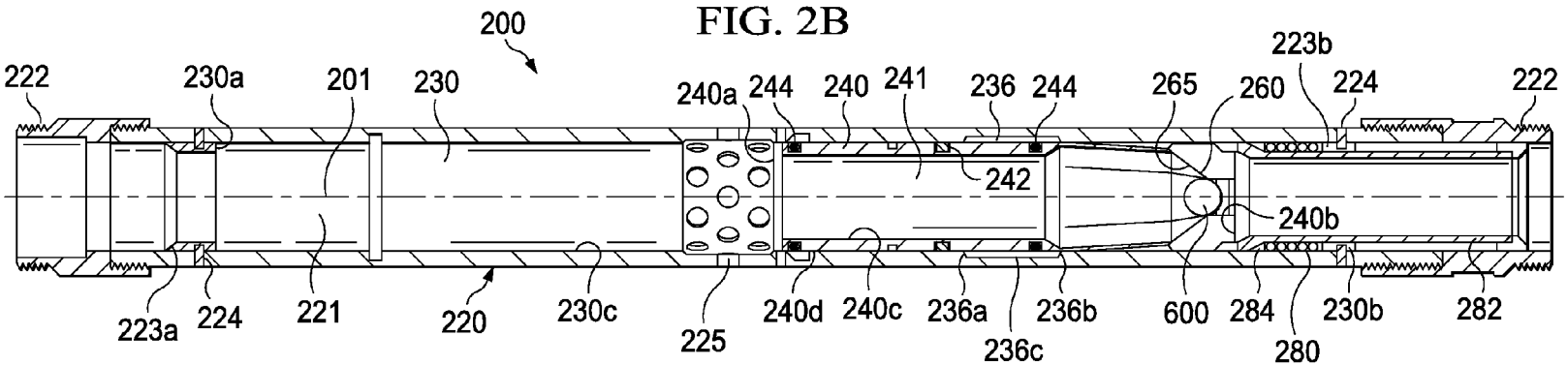
FIG. 2B is a cross-sectional view of an embodiment of the ASA of FIG. 1 in a second, activated configuration.

Referring to FIG. 2B, an embodiment of an ASA 200 is illustrated in the second mode or configuration. In an embodiment, when the ASA 200 is in the second mode or configuration, also referred to as an operational, fully-open, or activated mode, the ASA 200 will provide a route of fluid communication via ports 225 from the flowbore 161 of the casing 160 to the proximate and/or substantially adjacent zone of the subterranean formation 102 and the expandable seat 260 will be retained in a narrower, non-expanded conformation, as will be described herein.

Figure 2C:
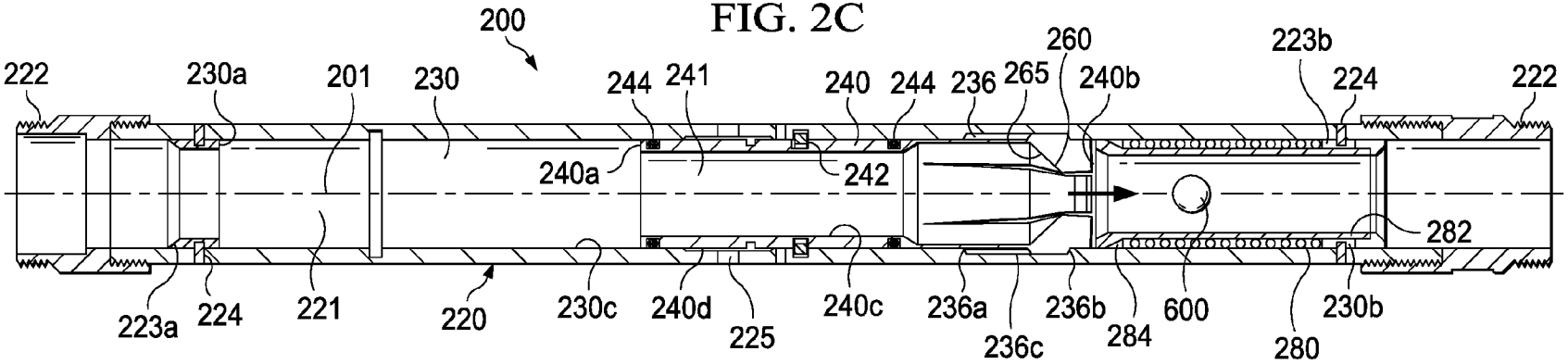
FIG. 2C is a cross-sectional view of an embodiment of the ASA of FIG. 1 in a third, post-operational configuration.

Referring to FIG. 2C, an embodiment of an ASA 200 is illustrated in the third mode or configuration. In an embodiment, when the ASA 200 is in the third mode or configuration, also referred to as a post-operational mode, the ASA will not provide a route of fluid communication via ports 225 from the flowbore 161 of the casing 160 to the proximate and/or substantially adjacent zone of the subterranean formation 102 and the expandable seat 260 will be allowed to expand into a larger, expanded conformation, as will be described herein.

Figure 2D:
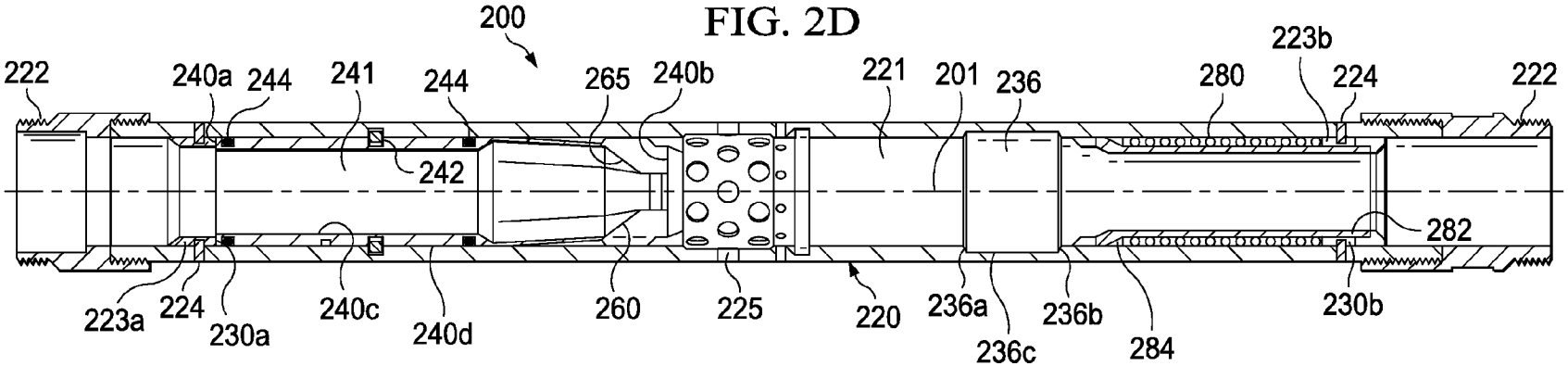
FIG. 2D is a cross-sectional view of an embodiment of the ASA of FIG. 1 in a fourth, manually-opened configuration.

Referring to FIG. 2D, an embodiment of an ASA 200 is illustrated in the fourth mode or configuration. In an embodiment, when the ASA 200 is in the fourth mode or configuration, also referred to as a manually-opened production mode, the ASA will provide a route of fluid communication via ports 225 between the flowbore 161 of the casing 160 and the proximate and/or substantially adjacent zone of the subterranean formation 102.

Figure 2E:
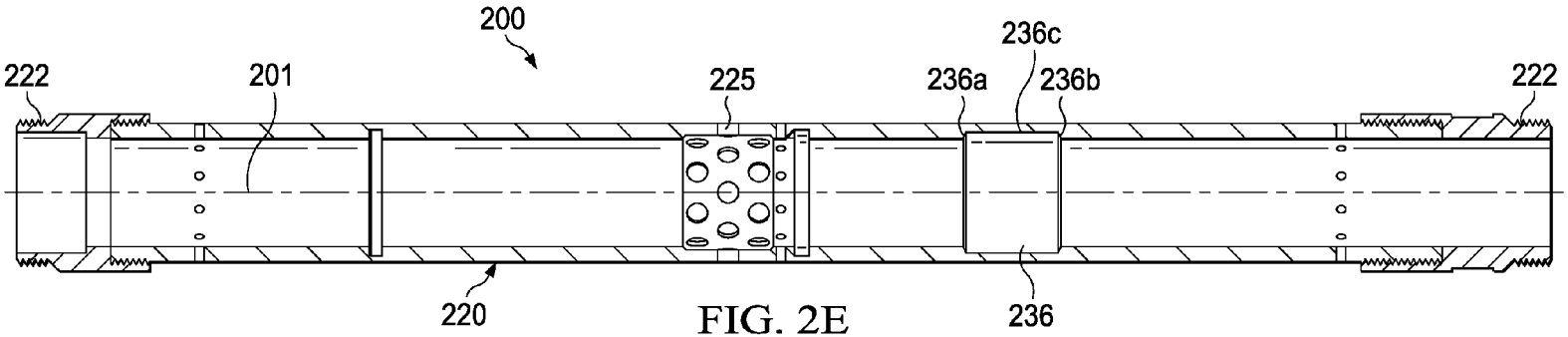
FIG. 2E is a cross-sectional view of an embodiment of the ASA of FIG. 1 in a fifth, sleeve-removed configuration.

Referring to FIG. 2E, an embodiment of an ASA 200 is illustrated in the fifth mode or configuration. In an embodiment, when the ASA 200 is in the fifth mode or configuration, also referred to as a sleeve-removed production mode or configuration, the ASA will provide a route of fluid communication via ports 225 between the flowbore 161 of the casing 160 and the proximate and/or substantially adjacent zone of the subterranean formation 102.

Referring to FIGS. 2A, 2B, 2C, 2D, and 2E the ASA 200 may be characterized as having a longitudinal axis 201. Dependent upon the mode or configuration in which the ASA 200 is configured, as will be discussed herein, the ASA 200 generally comprises a housing 220, a sliding sleeve 240, an expandable seat 260, and a biasing member 280.

In an embodiment, the housing 220 may be characterized as a generally tubular body defining an axial flowbore 221. In an embodiment, the housing 220 may be configured for connection to and/or incorporation within a casing such as the casing 160. For example, the housing 220 may comprise a suitable means of connection to the casing 160 (e.g., to a casing member such as casing joint or the like). For example, in the embodiment of FIGS. 2A, 2B, 2C, 2D, and 2E, the terminal ends of the housing 220 comprise one or more internally and/or externally threaded surfaces 222, for example, as may be suitably employed in making a threaded connection to the casing 160. Alternatively, an ASA like ASA 200 may be incorporated within a casing like casing 160 by any suitable connection, such as, for example, via one or more quick-connector type connections. Suitable connections to a casing member will be known to those of skill in the art viewing this disclosure. The axial flowbore 221 may be in fluid communication with the axial flowbore 161 defined by the casing 160. For example, a fluid communicated via the axial flowbores 161 of the casing will flow into and via the axial flowbore 221.

In an embodiment, the housing 220 may comprise one or more ports 225 suitable for the communication of fluid from the axial flowbore 221 of the housing 220 to a proximate subterranean formation zone when the ASA 200 is so-configured (e.g., when the ASA 200 is activated). For example, in the embodiment of FIGS. 2A and 2C, the ports 225 within the housing 220 are obstructed, as will be discussed herein, and will not communicate fluid from the axial flowbore 221 to the surrounding formation. In the embodiment of FIGS. 2B, 2D, and 2E, the ports 225 within the housing 220 are unobstructed, as will be discussed herein, and may communicate fluid from the axial flowbore 221 to the surrounding formation 102. In an embodiment, the ports 225 may be fitted with one or more pressure-altering devices (e.g., nozzles, erodible nozzles, or the like). In an additional embodiment, the ports 225 may be fitted with plugs, screens, covers, or shields, for example, to prevent debris from entering the ports 225.

In an embodiment, the housing 220 may comprise a unitary structure (e.g., a continuous length of pipe or tubing); alternatively, the housing 220 may comprise two or more operably connected components (e.g., two or more coupled sub-components, such as by a threaded connection). Alternatively, a housing like housing 220 may comprise any suitable structure; such suitable structures will be appreciated by those of skill in the art with the aid of this disclosure.

For example, in the embodiment of FIGS. 2A, 2B, 2C, and 2D, the housing 220 may comprise a first collar 223*a* and a second collar 223*b*. The first collar 223*a* and the second collar 223*b* may each comprise a generally cylindrical or tubular structure. The first collar 223*a* and/or the second collar 223*b* may be releasably fitted within the housing 220. In such an embodiment, the first collar 223*a* and/or the second collar 223*b* may be releasably and/or removably secured within the housing 220 by any suitable structure(s), examples of which include but are not limited to shear-pins, snap-rings, or the like. For example, in the embodiment of the FIGS. 2A, 2B, 2C, and 2D, the first collar 223*a* and the second collar 223*b* are secured to and/or within the housing 220 via a plurality of shear-pins 224 extending between the housing 220 and the first and second collars 223*a*, 223*b*. Alternatively, collars like the first collar 223*a* and/or the second collar 223*b* may be formed from a suitable drillable material as may be removed by drilling.

In an embodiment, the housing 220 comprises a bore. For example, in the embodiment of FIGS. 2A, 2B, 2C, and 2D, the housing 220, the first collar 223*a*, and the second cooperatively, generally define a sleeve bore 230. The sleeve bore 230 may generally comprise a passageway (e.g., a circumferential recess extending a length parallel to the longitudinal axis 201) in which the sliding sleeve 240 and/or the biasing member 280 may move longitudinally, axially, radially, or combinations thereof within the axial flowbore 221. In an embodiment, the sleeve bore 230 may comprise one or more grooves, guides, or the like (e.g., longitudinal grooves), for example, to align and/or orient the sliding sleeve 240 via a complementary structure (e.g., one or more lugs) on the sliding sleeve 240. In the embodiment of FIGS. 2A, 2B, 2C, and 2D, the sleeve bore 230 is generally defined by an upper shoulder 230*a* formed by the first collar 223*a*, a lower shoulder 230*b* formed by the second collar 223*b*, and the sleeve bore surface 230*c* extending between the upper shoulder 230*a* and lower shoulder 230*b*, that is between the first collar 223*a* and the second collar 223*b*.

In an embodiment, the housing 220 further comprises an expanded seat recess 236. For example, in the embodiment of FIGS. 2A, 2B, 2C, 2D, and 2E, the housing 220 comprises an expanded seat recess 236 and, more specifically, the expanded seat recess 236 is located within the sleeve bore 230. The expanded seat recess 236 may generally comprise a relatively wider, larger diameter portion (e.g., a circumferential recess extending a length along the longitudinal axis 201) into which the expandable seat 280 may move and, thereby, be allowed to expand into the larger, expanded conformation, as will be disclosed herein. In the embodiment of FIGS. 2A, 2B, 2C, 2D, and 2E, the expanded seat recess 236 is generally defined by an upper shoulder 236*a*, a lower shoulder 236*b*, and the sleeve bore surface 236*c* extending between the upper shoulder 236*a* and lower shoulder 236*b*. Also, in the embodiment of FIGS. 2A, 2B, 2C, 2D, and 2E, the expanded seat recess 236 may be characterized as comprising an inner diameter greater than the inner diameter of the sleeve bore 230.

In an embodiment, the sliding sleeve 240 generally comprises a cylindrical or tubular structure. In an embodiment, the sliding sleeve 240 generally comprises an upper orthogonal face 240*a*, a lower orthogonal face 240*b*, an inner cylindrical surface 240*c* at least partially defining an axial flowbore 241 extending therethrough, and an outer cylindrical surface 240*d*. In an embodiment, the axial flowbore 241 defined by the sliding sleeve 240 may be coaxial with and in fluid communication with the axial flowbore 221 defined by the housing 220. In an embodiment, the thickness of the sliding sleeve 240 is about equal to the thickness or depth of the sleeve bore 230 such that the inside diameter of the axial flowbores 221, 241 are about equal. In the embodiment of FIGS. 2A, 2B, 2C, and 2D, the sliding sleeve 240 may comprise a single component piece. In an alternative embodiment, a sliding sleeve like the sliding sleeve 240 may comprise two or more operably connected or coupled component pieces.

In an embodiment, the sliding sleeve 240 may be slidably and concentrically positioned within the housing 220. In the embodiment of FIGS. 2A, 2B, 2C, and 2D, the sliding sleeve 240 may be positioned within the sleeve bore 230. For example, at least a portion of the outer cylindrical surface 240*d* of the sliding sleeve 240 may be slidably fitted against at least a portion of the sleeve bore surface 230*c*.

In an embodiment, the sliding sleeve 240, the sleeve bore 230, or both may comprise one or more seals at the interface between the outer cylindrical surface 240*d* of the sliding sleeve 240 and the sleeve bore surface 230*c*. For example, in an embodiment, the sliding sleeve 240 may further comprise one or more radial or concentric recesses or grooves configured to receive one or more suitable fluid seals 244, for example, to restrict fluid movement via the interface between the sliding sleeve 240 and the sleeve bore 230. Suitable seals include but are not limited to a T-seal, an O-ring, a gasket, or combinations thereof.

In an embodiment, the expandable seat 260 may be configured to receive, engage, and/or retain an obturating member (e.g., a ball or dart) of a given size and/or configuration moving via axial flowbores 221 and 241 when the expandable seat 260 is in the narrower, non-expanded conformation and to allow the passage of that obturating member when the expandable seat 260 is in the wider, expanded conformation. For example, in an embodiment the seat 260 comprises a reduced flowbore diameter in comparison to the diameter of axial flowbores 221 and 241 and a bevel or chamfer 265 at the reduction in flowbore diameter, for example, to engage and retain such an obturating member.

In an embodiment, the expandable seat 260 may be integral with (e.g., joined as a single unitary structure and/or formed as a single piece) and/or connected to the sliding sleeve 240. For example, in the embodiment of FIGS. 2A, 2B, 2C, and 2D, the expandable seat 260 is integrated within the sliding sleeve 240. In the embodiment of FIGS. 2A, 2B, 2C, and 2D, the expandable seat 260 comprises a collet integrated within the sliding sleeve 240. In such an embodiment, the collet may comprise a plurality of radially, outwardly biased collet fingers. Such collet fingers may be configured to retain an obturating member when the collet fingers are retained in a narrower, non-expanded conformation and to allow the passage of the obturating member when the collet fingers are not retained in the narrower, non-expanded conformation (e.g., when the collet finger expand radially outward).

Figure 3B:
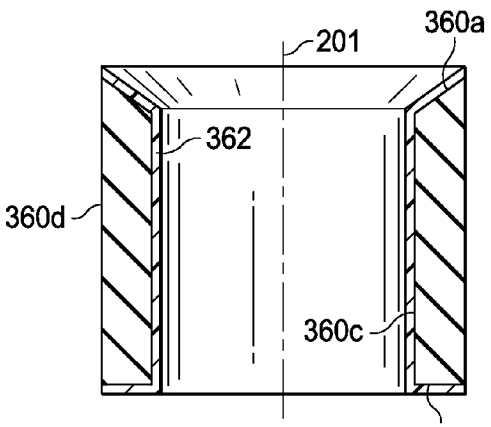
FIG. 3B is a cross-sectional view of an embodiment of an expandable, segmented seat having a protective sheath covering at least some of the surfaces thereof.
Figure 3A:
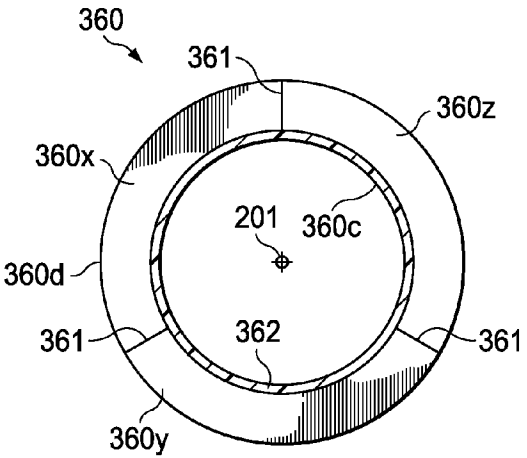
FIG. 3A is an end view of an embodiment of an expandable, segmented seat having a protective sheath covering at least some of the surfaces thereof.

In an alternative embodiment, an expandable seat may comprise an independent and/or separate component from the sliding sleeve. For example, in such an embodiment, the expandable seat may comprise a segmented seat. Referring to FIGS. 3A and 3B, an embodiment of such an expandable seat 360 is illustrated generally comprising a chamfer 360*a* an inner bore 360*c*, a lower face 360*b*, and an outer cylinder surface 360*d*. In such an embodiment, the segmented seat 360 may be slidably fitted within the housing 220, particularly, within the sleeve bore 230, abutting a sliding sleeve like sliding sleeve 240. For example, the lower face 360*b* of the segmented seat 360 may abut and/or rest upon the upper orthogonal face 240*a* of the sliding sleeve 240.

In an embodiment, such a segmented seat 360 may be radially divided with respect to central axis into a plurality of segments. For example, referring now to FIG. 3A, the expandable, segmented seat 360 is illustrated as divided (e.g., as represented by dividing or segmenting lines/cuts 361) into three complementary segments of approximately equal size, shape, and/or configuration. In the embodiment of FIG. 3A, the three complementary segments (360X, 360Y, and 360Z, respectively) together form the expandable, segmented seat 360, with each of the segments (360X, 360Y, and 360Z) constituting about one-third (e.g., extending radially about 120°) of the expandable, segmented seat 360. In an alternative embodiment, a segmented seat like expandable, segmented seat 360 may comprise any suitable number of equally or unequally-divided segments. For example, a segmented seat may comprise two, four, five, six, or more complementary, radial segments. The segments (e.g., 360X, 360Y, and 360Z, respectively) may comprise separate and independent structures separable at dividing lines 361 (e.g., the dividing lines 361 may represent complete cuts). Alternatively, the segments (e.g., 360X, 360Y, and 360Z, respectively) may be partially joined at the dividing lines 361 (e.g., the dividing lines 361 may represent incomplete cuts, joints, perforations, weakened portions, or the like) which may allow the segments to break apart, spring apart, or the like.

The expandable, segmented seat 360 may be formed from a suitable material. Nonlimiting examples of such a suitable material include composites, phenolics, cast iron, aluminum, brass, various metal alloys, rubbers, ceramics, or combinations thereof. In an embodiment, the material employed to form the segmented seat may be characterized as drillable, that is, the expandable, segmented seat 360 may be fully or partially degraded or removed by drilling, as will be appreciated by one of skill in the art with the aid of this disclosure. Segments 360X, 360Y, and 360Z may be formed independently or, alternatively, a preformed seat may be divided into segments.

In an alternative embodiment, an expandable seat may be constructed from a generally serpentine length of a suitable material and may comprise a plurality of serpentine loops between upper and lower portions of the seat and continuing circumferentially to form the seat. Such an expandable seat is generally configured to be biased radially outward so that if unrestricted radially, the outer and/or inner diameter of the seat will increase. In some embodiments, examples of a suitable material may include but are not limited to, a low alloy steel such as AISI 4140 or 4130.

In an embodiment, one or more surfaces of the expandable seat 360 may be covered by a protective sheath 362. Referring to FIGS. 3A and 3B, an embodiment of the expandable, segmented seat 360 and protective sheath 362 are illustrated in greater detail. In the embodiment of FIG. 3B, the protective sheath 362 covers the surfaces of the chamfer 360*a* of the expandable, segmented seat 360, the inner bore 360*c* of the expandable, segmented seat 360, and the lower face 360*b* of the expandable, segmented seat 360. In an alternative embodiment, a protective sheath may cover the chamfer 360*a*, the inner bore 360*c*, the lower orthogonal face 360*b*, the outer cylinder surface 360*d*, or combinations thereof. In another alternative embodiment, a protective sheath may cover any one or more of the surfaces of a segmented seat 360, as will be appreciated by one of skill in the art viewing this disclosure. In the embodiment illustrated by FIGS. 3A and 3B, the protective sheath 362 forms a continuous layer over those surfaces of the expandable, segmented seat 360 in fluid communication with the flowbore 201. For example, small crevices or gaps (e.g., at dividing lines 361) may exist at the radially extending divisions between the segments (e.g., 360X, 360Y, and 360Z) of the expandable seat 360. In an embodiment, the continuous layer formed by the protective sheath 362 may fill, seal, minimize, or cover, any such crevices or gaps such that a fluid flowing via the flowbore 201 (and/or particulate material therein) will be impeded from contacting and/or penetrating any such crevices or gaps.

Additionally, in an embodiment a protective sheath similar to protective sheath 362 disclosed with reference to FIGS. 3A and 3B may be similarly applied to at least a portion of one or more surfaces of the sliding sleeve 240 and/or the expandable seat 260. For example, in an embodiment such a protective coating may be applied to the inner cylindrical surface 240*c* (including the collet fingers of the expandable seat 260), the upper orthogonal face 240*a*, the lower orthogonal face 240*b*, the bevel or chamfer 265, or combinations thereof.

In an embodiment, a protective sheath, like protective sheath 362, may be formed from a suitable material. Nonlimiting examples of such a suitable material include ceramics, carbides, plastics (e.g., hardened plastics, elastomeric plastics, etc.), molded rubbers, various heat-shrinkable materials, or combinations thereof. In an embodiment, the protective sheath may be characterized as having a Shore A or D hardness of from about 25 durometers to about 150 durometers, alternatively, from about 50 durometers to about 100 durometers, alternatively, from about 60 durometers to about 80 durometers. In an embodiment, the protective sheath may be characterized as having a thickness of from about $1/64^{th}$ of an inch to about $3/16^{th}$ of an inch, alternatively, about $1/32^{nd}$ of an inch. Examples of materials suitable for the formation of the protective sheath include nitrile rubber, which commercially available from several rubber, high-impact polystyrene, plastic, and/or composite materials companies.

In an embodiment, a protective sheath, like protective sheath 362, may be employed to advantageously lessen the degree of erosion and/or degradation to an expandable, like expandable seat 260, or to a segmented seat, like expandable seat 360. Not intending to be bound by theory, such a protective sheath may improve the service life of a segmented seat covered by such a protective sheath by decreasing the impingement of erosive fluids (e.g., cutting, hydrojetting, and/or fracturing fluids comprising abrasives and/or proppants) with the segmented seat. In an embodiment, a segmented seat protected by such a protective sheath may have a service life at least 20% greater, alternatively, at least 30% greater, alternatively, at least 35% greater than an otherwise similar seat not protected by such a protective sheath.

In an embodiment, the expandable seat 260 or the segmented seat 360 may further comprise a seat gasket that serves to seal against an obturator. For example, such a seat gasket may be attached and/or applied to bevel or chamfer 265 (e.g., of expandable seat 260) or to the chamfer 360*a* (of segmented seat 360). In an embodiment, the seat gasket may be constructed of rubber or like materials. In an embodiment, the protective sheath disclosed herein may serve as such a gasket, for example, by engaging and/or sealing an obturator. In such an embodiment, the protective sheath may have a variable thickness (e.g., a thicker portion, such as the portion covering the chamfer 360*a*, relative to the thickness of other portions). For example, the surface(s) of the protective sheath configured to engage the obturator at chamfer 265 or 360*a* may comprise a greater thickness (e.g., operable as a seat gasket) than the one or more other surfaces of the protective sheath.

In an embodiment, the biasing member 280 generally comprises a suitable structure or combination of structures configured to apply a directional force and/or pressure to the sliding sleeve 240 with respect to the housing 220. Examples of suitable biasing members include a spring, a compressible fluid or gas contained within a suitable chamber, an elastomeric composition, a hydraulic piston, or the like. For example, in the embodiment of FIGS. 2A, 2B, 2C, and 2D, the biasing member 280 comprises a spring.

In an embodiment, the biasing member 280 may be concentrically positioned within the sleeve bore 230. The biasing member 280 may be configured to apply a directional force to the sliding sleeve 240. For example, in the embodiment of FIGS. 2A, 2B, and 2C, the biasing member 280 is configured to apply an upward force (i.e., to the left in the Figures) to the sliding sleeve 240 throughout at least a portion of the length of the movement of the sliding sleeve within the sleeve bore 230.

In an embodiment, the biasing member 280 may be housed within a suitable protective structure. For example, in the embodiment of FIGS. 2A, 2B, and 2C, a sheath 282 covers at least a portion of the biasing member 280 (e.g., an inner diameter/surface of a spring). In the embodiment of FIGS. 2A, 2B, and 2C, the sheath 282 further comprises a ring 284 fitted within the sleeve bore 230 between the biasing member 280 (e.g., the spring) and the sliding sleeve 240 such that the force applied by the spring is applied via the ring 284.

In an embodiment, the sliding sleeve 240 may be slidably movable from a first position to a second position within the sleeve bore 230 and from the second position to a third position within the sleeve bore 230. In an additional embodiment, the sliding sleeve 240 may be slidably movable from the third position to a fourth position within the sleeve bore 230. In another additional embodiment, the sliding sleeve 240 and one or more of the seat 260, the biasing member 280, the first collar 223*a*, or the second collar 223*b* may be removable from the housing 220.

Referring again to FIG. 2A, the sliding sleeve 240 is shown in the first position. In the first position, the lower orthogonal face 240*b* of the sliding sleeve 240 abuts the ring 284 and the biasing member 280 may be partially compressed. For example, when the sliding sleeve 240 is in the first position, the biasing member 280 may be less compressed relative to the compression of the biasing member 280 in the second position and more compressed relative to the compression of the biasing member 280 in the third position. When the sliding sleeve 240 is in the first position, the sliding sleeve 240 may be characterized as in an intermediate position, relative to the position of the sliding sleeve in either its second or third positions, within the sleeve bore 230. In the embodiment illustrated in FIG. 2A, when the sliding sleeve 240 is in the first position, the sliding sleeve 240 may obstruct the ports 225 of the housing 220, for example, such fluid will not be communicated between the flowbore 161 of the casing 160 and the proximate and/or substantially adjacent zone of the subterranean formation 102 via the ports 225. In an embodiment, the sliding sleeve 240 may be held in the first position by suitable retaining mechanism. For example, in the embodiment of FIG. 2A, the first sliding sleeve 240 is retained in the first position by one or more shear-pins 248 or the like. The shear pins may be received by shear-pin bore within the first sliding sleeve 240 and shear-pin bore in the tubular body 220. In an embodiment, when the sliding sleeve 240 is in the first position, the ASA 200 is configured in the first mode or configuration.

Referring again to FIG. 2B, the sliding sleeve 240 is shown in the second position. In the second position, the lower orthogonal face 240*b* of the sliding sleeve 240 abuts the ring 284 and the biasing member may be fully compressed, nearly fully compressed, and/or highly compressed. For example, when the sliding sleeve 240 is in the second position, the biasing member 280 may be more compressed relative to the compression of the biasing member 280 in either the first or third positions. When the sliding sleeve 240 is in the second position, the sliding sleeve 240 may be characterized as in a lower position, relative to the position of the sliding sleeve 240 in either its first or third positions, within the sleeve bore 230. In the embodiment illustrated in FIG. 2B, when the sliding sleeve 240 is in the second position, the sliding sleeve 240 does not obstruct the ports 225 of the housing 220, for example, such fluid may be communicated between the flowbore 161 of the casing 160 and the proximate and/or substantially adjacent zone of the subterranean formation 102 via the ports 225. In an embodiment, when the sliding sleeve 240 is in the second position, the ASA 200 is configured in the second mode or configuration.

Referring again to FIG. 2C, the sliding sleeve 240 is shown in the third position. In the third position, the lower orthogonal face 240*b* of the sliding sleeve 240 abuts the ring 284 and the biasing member may be nearly uncompressed and/or uncompressed. For example, when the sliding sleeve 240 is in the third position, the biasing member 280 may be less compressed relative to the compression of the biasing member 280 in either the first or second positions. When the sliding sleeve 240 is in the third position, the sliding sleeve 240 may be characterized as in an upper position, relative to the position of the sliding sleeve 240 in either its first or second position, within the sleeve bore 230. In the embodiment illustrated in FIG. 2C, when the sliding sleeve 240 is in the third position, the sliding sleeve 240 may obstruct the ports 225 of the housing 220, for example, such fluid will not be communicated between the flowbore 161 of the casing 160 and the proximate and/or substantially adjacent zone of the subterranean formation 102 via the ports 225. In an embodiment, the sliding sleeve 240 may be held in the third position by suitable retaining mechanism. For example, in the embodiment of FIG. 2C, the first sliding sleeve 240 is retained in the third position by a snap-ring 242 or the like. The snap-ring pins may be received and/or carried within snap-ring groove within the first sliding sleeve 240. The snap-ring 242 may expand into a complementary groove within the tubular body 220 when the sliding sleeve 240 is in the third position and, thereby, retain the sliding sleeve in the third position. In an embodiment, when the sliding sleeve 240 is in the third position, the ASA 200 is configured in the third mode or configuration.

In an alternative embodiment, a sliding sleeve like sliding sleeve 240 may comprise one or more ports suitable for the communication of fluid from the axial flowbore 221 of the housing 220 and/or the axial flowbore 241 of the sliding sleeve 240 to a proximate subterranean formation zone when the master ASA 200 is so-configured. For example, in an embodiment where such a sliding sleeve is in either the first position or the third position, as disclosed herein above, the ports within the sliding sleeve 240 will be misaligned with the ports 225 of the housing and will not communicate fluid from the axial flowbore 241 and/or axial flowbore 241 to the wellbore and/or surrounding formation. When such a sliding sleeve is in the second position, as disclosed herein above, the ports within the sliding sleeve will align with the ports 225 of the housing and will communicate fluid from the axial flowbore 221 and/or axial flowbore 241 to the wellbore and/or surrounding formation.

In an additional embodiment, the sliding sleeve 240 may be transitionable to a fourth position. Referring to FIG. 2D, the sliding sleeve 240 is shown in a fourth position in which the sliding sleeve 240 abuts and/or is located adjacent to the first collar 223*a*. For example, in the embodiment of FIG. 2D the upper orthogonal face 240*a* of the sliding sleeve 240 abuts the shoulder 230*a* of the sleeve bore 230 formed by the first collar 223*a*. When the sliding sleeve 240 is in the fourth position, the sliding sleeve 240 may be characterized as in it uppermost position within the sleeve bore 230. In the embodiment illustrated in FIG. 2D, when the sliding sleeve 240 is in the fourth position, the sliding sleeve 240 does not obstruct the ports 225 of the housing 220, for example, such fluid may be communicated between the flowbore 161 of the casing 160 and the proximate and/or substantially adjacent zone of the subterranean formation 102 via the ports 225. In an embodiment, when the sliding sleeve 240 is in the fourth position, the ASA 200 is configured in the fourth mode or configuration.

In another additional embodiment, the sliding sleeve 240 and one or more of the seat 260, the biasing member 280, the first collar 223*a*, or the second collar 223*b* may be removable from the housing 220, for example as will be discussed in greater detail herein. Referring to FIG. 2E, the sliding sleeve 240, the seat 260, the biasing member 280, the first collar 223*a*, and the second collar 223*b* are absent (e.g., have been removed, as will be disclosed herein) from the housing 220. With the sliding sleeve 240 removed from the housing 220, the ports 225 of the housing 220 are unobstructed, for example, such fluid may be communicated between the flowbore 161 of the casing 160 and the proximate and/or substantially adjacent zone of the subterranean formation 102 via the ports 225. In an embodiment, when the sliding sleeve 240 and one or more of the seat 260, the biasing member 280, the first collar 223*a*, or the second collar 223*b* have been removed from the housing 220, the ASA 200 is configured in the fifth mode or configuration.

One or more of embodiments of a wellbore servicing system 100 comprising one or more ASAs 200 (e.g., ASAs 200*a*-200*f*) having been disclosed, one or more embodiments of a wellbore servicing method employing such a wellbore servicing system 100 and/or such an ASA 200 are also disclosed herein. In an embodiment, a wellbore servicing method may generally comprise the steps of positioning a wellbore servicing system comprising two or more ASAs within a wellbore such that each of the ASAs are proximate to a zone of a subterranean formation, isolating adjacent zones of the subterranean formation, transitioning a first ASA from the first mode to the second mode, communicating a servicing fluid to the zone proximate to the first ASA via the first ASA, and allowing the first ASA to transition from the second mode to the third mode. The process of transitioning an ASA from the first mode to the second mode, communicating a servicing fluid to the zone proximate to the ASA via that ASA, and allowing the ASA to transition from the second mode to the third mode may be repeated, as will be disclosed herein, working progressively further down-hole, for as many ASAs as may be incorporated within the wellbore servicing system. Optionally, upon completion of the servicing operation with respect to one or more of the ASAs incorporated within the wellbore servicing system, the wellbore servicing system may be configured for production of a fluid from the subterranean formation, for example, via rearrangement and/or via removal of one or more internal components of the ASAs.

In an embodiment, one or more ASAs may be incorporated within a casing like casing 160 may be positioned within a wellbore like wellbore 114. For example, in the embodiment of FIG. 1, the casing 160 has incorporated therein the first ASA 200*a*, the second ASA 200*b*, the third ASA 200*c*, the fourth ASA 200*d*, the fifth ASA 200*e*, and the sixth ASA 200*f*. Also in the embodiment of FIG. 1, the casing 160 is positioned within the wellbore 114 such that the first ASA 200*a* is proximate and/or substantially adjacent to the first subterranean formation zone 2, the second ASA 200*b* is proximate and/or substantially adjacent to the second zone 4, the third ASA 200*c* is proximate and/or substantially adjacent to the third zone 6, the fourth ASA 200*d* is proximate and/or substantially adjacent to the fourth zone 8, the fifth ASA 200*e* is proximate and/or substantially adjacent to the fifth zone 10, and the sixth ASA 200*f* is proximate and/or substantially adjacent to the sixth zone 12. Alternatively, any suitable number of ASAs may be incorporated within a casing string. In an embodiment, the ASAs (e.g., ASAs 200*a*-200*f*) may be positioned within the wellbore 114 in a configuration in which no ASA will communicate fluid to the subterranean formation, particularly, the ASAs may be positioned within the wellbore 114 in the first, run-in, or installation mode or configuration.

In an embodiment, the ASAs (e.g., ASAs 200*a*-200*f*) incorporated within the casing 160 may be configured such that all such ASAs will engage and retain the same obturating member (or a same or sufficiently-similarly sized obturating member) in the first and second positions and release the obturating member in the third position. For example, in the embodiment of FIG. 1 the seat of ASAs 200*a*-200*f* may be similarly configured (e.g., configured to engage the same size and/or configuration of obturating member and, similarly, to release the same size and/or configuration of obturating member), and thus, in some embodiments a single obturating member (or multiple obturating members of about the same size and/or configuration) may activate all ASAs.

In an embodiment, once the casing comprising the ASAs (e.g., ASAs 200*a*-200*f*) has been positioned within the wellbore, adjacent zones may be isolated. For example, in the embodiment of FIG. 1 the first zone 2 may be isolated from the second zone 4, the second zone 4 from the third zone 6, the third zone 6 from the fourth zone 8, the fourth zone 8 from the fifth zone 10, the fifth zone 10 from the sixth zone 12, or combinations thereof. In the embodiment of FIG. 1, the adjacent zones (2, 4, 6, 8, 10, and/or 12) are separated by one or more suitable wellbore isolation devices 130. Suitable wellbore isolation devices 130 are generally known to those of skill in the art and include but are not limited to packers, such as mechanical packers and swellable packers (e.g., Swellpackers™, commercially available from Halliburton Energy Services, Inc.), sand plugs, sealant compositions such as cement, or combinations thereof. In an alternative embodiment, only a portion of the zones (e.g., 2, 4, 6, 8, 10, and/or 12) may be isolated, alternatively, the zones may remain unisolated.

In an embodiment, the zones of the subterranean formation (e.g., 2, 4, 6, 8, 10, and/or 12) may be serviced working from the zone that is furthest up-hole (e.g., in the embodiment of FIG. 1, the first formation zone 2) progressively downward toward the furthest down-hole zone (e.g., in the embodiment of FIG. 1, the sixth formation zone 12).

In an embodiment, once the casing comprising the ASAs has been positioned within the wellbore and, optionally, once adjacent zones of the subterranean formation (e.g., 2, 4, 6, 8, 10, and/or 12) have been isolated, the first ASA 200*a* may be prepared for the communication of a fluid to the proximate and/or adjacent zone. In such an embodiment, the first ASA 200*a* (which is positioned proximate and/or substantially adjacent to the first zone 2) is transitioned from the first, deactivated mode or configuration to the second, activated mode or configuration. In an embodiment, transitioning the first ASA 200*a* to the second, activated mode or configuration may comprise introducing an obturating member (e.g., a ball or dart) configured to engage the seat of the first ASA 200*a* into the casing 160 and/or into the first casing string 150 and forward-circulating the obturating member to engage the expandable seat 260 of the first ASA 200*a*.

In an embodiment, when the obturating member has engaged the expandable seat 260, application of a fluid pressure to the flowbore 221, for example, by continuing to pump fluid may increase the force applied to the expandable seat 260 and the sliding sleeve 240 via the obturating member 600. Referring to FIG. 2B, application of sufficient force to the sleeve 240 via the expandable seat 260 (e.g., force sufficient to break shear-pin 248 and overcome the to force applied in the opposite direction by the biasing member 280) may cause the shear-pin 248 to shear, sever, or break, causing the sliding sleeve 240 to slidably move from the first position (e.g., as shown in FIG. 2A) to the second position (e.g., as shown in FIG. 2B) and thereby transitioning the first ASA 200*a* to the second, activated configuration and compressing the biasing member 280. In an alternative embodiment where the expandable seat comprises an independent component from the sliding sleeve (e.g., a segmented seat such as segmented seat 360), an obturating member may be similarly employed to move the sliding sleeve and expandable seat from the first position to the second position and hold the sliding sleeve and the expandable seat in the second position.

As the sliding sleeve 240 moves from the first position to the second position within the sleeve bore 230, the biasing member 280 is compressed, the ports 225 cease to be obscured by the sliding sleeve 240, and the expandable seat 260 is retained in the narrower, non-expanded conformation. Continued application of fluid pressure to the sliding sleeve 240 via the obturating member and the expandable seat 260 will hold the sliding sleeve 240 in the second position and the biasing member 280 will remain compressed.

In an embodiment, with the first ASA 200*a* transitioned to the activated configuration and held in the activated configuration by the application of fluid pressure via the obturating member and the expandable seat 260 such that the biasing member 280 remains compressed, a suitable wellbore servicing fluid may be communicated to the first subterranean formation zone 2 via the ports 225 of the first ASA 200*a*. Non-limiting examples of a suitable wellbore servicing fluid include but are not limited to a fracturing fluid, a perforating or hydrajetting fluid, an acidizing fluid, the like, or combinations thereof. The wellbore servicing fluid may be communicated at a suitable rate and pressure for a suitable duration. For example, the wellbore servicing fluid may be communicated at a rate and/or pressure sufficient to initiate or extend a fluid pathway (e.g., a perforation or fracture) within the subterranean formation 102 and/or a zone thereof.

In an embodiment, when an operator desires to cease the communication of fluid to the first formation zone 2, for example, when a desired amount of the servicing fluid has been communicated to the first formation zone 2, the first ASA 200*a* may be configured such that the first ASA 200*a* will not communicate fluid via ports 225 thereof to the proximate and/or adjacent formation zone (e.g., formation zone 2). In such an embodiment, the first ASA 200*a* may be allowed to transition from the second, activated mode to the third, post-operational mode. In an embodiment, allowing the first ASA 200*a* to transition from the second mode to the third mode may comprise decreasing the fluid pressure applied to the flowbore 221 such that the force applied to the sliding sleeve 240 and the expandable seat 260 thereof via the obturating member is less than the force applied in the opposite direction by the biasing member 280. Decreasing the force applied to the sleeve 240 via the expandable seat 260 may allow a sliding sleeve 240 to slidably move from the second position (e.g., as shown in FIG. 2B) to the third position (e.g., as shown in FIG. 2C) and thereby transitioning the first ASA 200*a* to the third, post-operational configuration. In an embodiment, the sliding sleeve 240 and the expandable seat 260 may move within the sleeve bore 230 until the biasing member 280 is uncompressed.

In the third position, where the biasing member is uncompressed and/or nearly uncompressed, the sliding sleeve 240 obscures the ports 225 and the expandable seat 260 is allowed to expand into the wider, expanded conformation. For example, referring to the embodiment of FIG. 2C, when the sliding sleeve 240 is in the third position, the expandable seat 260 is adjacent to the expanded seat recess 236. As such, the relatively wider, larger diameter of the expandable seat recess allows the expandable seat 260 to expand radially outward. When the expandable seat 260 expand radially outward within the expanded seat recess 236, the expandable seat 260 will not retain the obturating member 600, which is shown passing downward through the ASA in FIG. 2C. In the embodiment of FIG. 2C, as the sliding sleeve 240 moves into the third position, the snap-ring 242 becomes aligned with a complementary groove within the tubular body 220, and can therefore expand into the groove to retain the sliding sleeve 240 within the third position.

With the first ASA 200*a* in the third, post-operational mode, further forward-circulation via the casing 160 will cause the obturating member to move through the first ASA 200*a*. The obturating member may continue through the casing 160 until the obturating member reaches the second ASA 200*b* and engages and is retained by the expandable seat 260 therein. The process of transitioning the second ASA 200*b* from the first mode to the second mode, communicating a servicing fluid to the second formation zone 4 via the ports of the second ASA 200*b*, and allowing the second ASA 200*b* to transition from the second mode to the third mode may be performed as similarly disclosed with respect to the first ASA 200*a*. The third, fourth, fifth, and sixth formation zones 6, 8, 10, and 12, respectively, may be similarly serviced by the third, fourth, fifth, and sixth ASAs, 200*c*, 200*d*, 200*e*, and 200*f*, respectively, as disclosed above.

In an embodiment, upon completion of the servicing operation with respect to one or more of the formation zones (e.g., 2, 4, 6, 8, 10, and/or 12), one or more of the ASAs may be configured for production of a fluid from one or more of the formation zones. In an embodiment, configuring an ASA 200 for production may comprise manipulating the ASA 200 and/or the sliding sleeve 240 thereof to provide a route of fluid communication from the proximate and/or adjacent subterranean formation zone (e.g., 2, 4, 6, 8, 10, or 12) to the flowbore 221 of the ASA 200.

In an embodiment, manipulating the ASA 200 and/or the sliding sleeve 240 thereof may comprise utilizing a shifting tool, a fishing tool, a wireline tool, or combinations thereof to engage, manipulate, or remove one or more components of the ASA 200. For example, in the embodiment of FIG. 2D, such a tool may be employed to engage the sliding sleeve 240 and move the sliding sleeve 240 from the third position to the fourth position, and, thereby, transition the ASA to the fourth, manually-opened mode. In the fourth mode, the sliding sleeve 240 of the ASA 200 does not obscure the ports 225 and, thereby, provide a route of fluid communication (e.g., from a formation zone into the flowbore 221).

Also, in the embodiment of FIG. 2E, such a tool may be employed to engage the first collar 223*a* and/or the second collar 223*b*, and, when engaged to the first collar 223*a* and/or the second collar 223*b*, to remove the first collar 223*a* and/or the second collar 223*b*, for example, by shearing the shear pins 224 that hold the first collar 223*a* and/or the second collar 223*b* in place within the housing 220. Upon removal of the first collar 223*a* and/or the second collar 223*b*, such a tool may also be employed to engage and remove the sliding sleeve 240, the biasing member 280 and/or, in an embodiment where the expandable seat 260 is not integral with the sliding sleeve 240, the expandable seat 260, thereby configuring the ASA 200 in the fifth, sleeve-removed production mode. In the fifth, sleeve-removed mode, the ASA provides an unobstructed flow area and also provides a larger inner diameter allowing for tool passage, in the event that the well were to require a workover operation. In the fifth mode, the ports 225 are entirely unobscured and, thereby, provide a route of fluid communication.

In an embodiment, an ASA such as ASA 200, a wellbore servicing system such as wellbore servicing system 100, a wellbore servicing method employing such a wellbore servicing system 100 and/or such an ASA 200, or combinations thereof may be advantageously employed in the performance of a wellbore servicing operation. For example, as disclosed herein, all ASAs (e.g., ASA 200) of a common casing string may be actuated (e.g., transitioned from a first mode to a second mode, as disclosed herein) via the operation of a single obturating member or multiple obturating members of the same size. To the contrary, prior art devices or systems required multiple sizes and/or configurations of such obturating members and, additionally, such prior art devices were necessarily incorporated within a casing string and/or work string only in a particular order. As such, operators bore the risk of deploying such servicing tools in the wrong order and/or utilizing the wrong size and/or configuration of obturating member in conjunction with those tools. In the embodiments disclosed herein, because all ASAs (e.g., ASAs 200*a*-200*f*) may be actuated by a single obturating member and/or multiple obturating members of about the same size, such a risk (e.g., a risk of utilizing the wrong size and/or configuration of obtuaring member) is not present. Further, because multiple and/or all ASAs incorporated within a casing string may be similarly sized and/or configured (e.g., sized and/or configured to engage and retain the same obturating member), operators do not bear the risk of deploying the ASAs in the wrong order. Further still, the number of ASAs that may be incorporated within a given casing string is unlimited by the size and/or configuration of obturating member that may be employed. To the contrary, prior art devices, which required multiple sizes and/or configurations of such obturating members were limited in the number of such devices that could be employed within a single casing string by the number of different sizes and/or configurations of obturating members that were available, particularly, in that prior art devices configured to engage progressively smaller obturating members had the effect of impeding flow therethrough and, as such, could not be effectively employed in many servicing operations. Particularly, such prior art devices may have the effect of limiting fracturing pump rates and not allowing for passage of tools (e.g., cement wiper darts, coil tubing strings) to pass through the completion.

Additionally, because only a single obturating member need be deployed to operate/actuate all ASAs, less equipment is needed at the surface of the wellbore being serviced, thereby making the work area safer of reducing the costs associated with such surface equipment. Further, because all ASAs are similarly sized and/or configured, the costs and difficulties associated with deploying the ASAs may be decreased relative to the costs associated with deploying prior art devices, which required multiple sizes and/or configurations. Similarly, the ASAs may make field location inventory easier to manage and help avoid job delays.

In addition, as disclosed herein, because the formation zones (e.g., formation zones 2, 4, 6, 8, 10, and 12) may be serviced from the up-hole-most zone progressing further down-hole, the time required to complete the entirety of the servicing operation may be decreased relative to an otherwise similar servicing operation that is performed from the down-hole-most zone and progressing further up-hole. As disclosed herein, after the up-hole-most zone has been serviced, the operation progresses to the second-most-up-hole zone, particularly, by forward-circulating the obturating member from the up-hole-most ASA (e.g., ASA 200*a*) to the second-most-up-hole ASA (e.g., ASA 200*b*). Therefore, it is not necessary to introduce and forward-circulate an additional, obturating member for each additional ASA. As such, the time that would conventionally be required to pump a second, third, fourth, etc., obturating member to the up-hole-most ASA is omitted. Additionally, because it is not necessary to introduce and forward-circulate a second obturating member for each ASA, the fluid that would conventionally be required to pump a second, third, fourth, etc., obturating member is not required, thereby decreasing costs associated with such servicing operations and decreasing the environmental impact of the servicing operation. Further still, because a formation may be serviced in such a "top-down" fashion, there is no need to isolate those zones below a particular zone being serviced, particularly, in that the ASAs associated with the relatively more downhole zones remain configured to not communicate fluid during the servicing of a relatively more uphole zone.

ADDITIONAL DISCLOSURE

The following are nonlimiting, specific embodiments in accordance with the present disclosure:

Embodiment A

A wellbore servicing apparatus comprising:

a housing substantially defining an axial flowbore and comprising one or more ports;

an expandable seat; and a sliding sleeve slidably fitted within the housing, the sliding sleeve being transitional from a first position relative to the housing to a second position relative to the housing and from the second position to a third position relative to the housing, wherein, in the first position, the sliding sleeve does not permit fluid communication from the axial flowbore to an exterior of the housing via the one or more ports and the expandable seat is retained in a narrower, non-expanded conformation, wherein, in the second position, the sliding sleeve permits fluid communication from the axial flowbore to the exterior of the housing via the one or more ports and the expandable seat is retained in a narrower, non-expanded conformation, and wherein, in the third position, the sliding sleeve does not permit fluid communication from the axial flowbore to the exterior of the housing via the one or more ports and the expandable seat is allowed to expand into a wider, expanded conformation.

Embodiment B

The wellbore servicing apparatus of embodiment A, wherein the expandable seat is configured to engage an obturating member.

Embodiment C

The wellbore servicing apparatus of one of embodiments A through B, wherein the housing further comprises a sliding sleeve recess and wherein the sliding sleeve is slidably fitted within the sliding sleeve recess of the housing.

Embodiment D

The wellbore servicing apparatus of embodiment C, wherein the sliding sleeve recess is substantially defined by a first collar, a second collar, and an inner bore surface of the housing.

Embodiment E

The wellbore servicing apparatus of embodiment D, wherein the first collar, the second collar, or both are removable from housing.

Embodiment F

The wellbore servicing apparatus of one of embodiments D through E, wherein the first collar, the second collar, or both are retained within the housing by shear-pins.

Embodiment G

The wellbore servicing apparatus of one of embodiments A through F, wherein the expandable seat is incorporated within the sliding sleeve.

Embodiment H

The wellbore servicing apparatus of one of embodiments A through G, wherein the housing further comprises an expandable seat recess.

Embodiment I

The wellbore servicing apparatus of embodiment H, wherein the expandable seat recess is characterized as having a diameter greater than the diameter of the inner bore surface of the housing.

Embodiment J

The wellbore servicing apparatus of one of embodiments A through I, further comprising a biasing member, wherein, when the sliding sleeve is in the first position, the biasing member is partially compressed, wherein, when the sliding sleeve is in the second position, the biasing member is more compressed relative to when the sliding sleeve is in the first position, and wherein, when the sliding sleeve is in the third position, the biasing member is less compressed relative to when the sliding sleeve is in either the first position or the second position.

Embodiment K. A wellbore servicing system comprising a casing string having incorporated therein a first wellbore servicing apparatus and a second wellbore servicing apparatus, each of the first wellbore servicing apparatus and the second wellbore servicing apparatus comprising:

a housing substantially defining an axial flowbore and comprising a one or more ports;

a expandable seat; and a sliding sleeve slidably fitted within the housing, the sliding sleeve being transitional from a first position relative to the housing to a second position relative to the housing and from the second position to a third position relative to the housing, wherein, in the first position, the sliding sleeve does not permit fluid communication from the axial flowbore to an exterior of the housing via the one or more ports and the expandable seat is retained in a narrower, non-expanded conformation, wherein, in the second position, the sliding sleeve permits fluid communication from the axial flowbore to the exterior of the housing via the one or more ports and the expandable seat is retained in a narrower, non-expanded conformation, and wherein, in the third position, the sliding sleeve does not permit fluid communication from the axial flowbore to the exterior of the housing via the one or more ports and the expandable seat is allowed to expand into a wider, expanded conformation.

Embodiment L

The wellbore servicing apparatus of embodiment K, wherein the first wellbore servicing apparatus is up-hole relative to the second wellbore servicing apparatus.

Embodiment M

The wellbore servicing system of embodiment L, wherein the expandable seat of the first wellbore servicing apparatus and the expandable seat of the second wellbore servicing apparatus are configured to engage an obturating member of the same size and configuration.

Embodiment N

A process for servicing a wellbore comprising:

positioning a casing string within the wellbore, the casing string having incorporated therein a first wellbore servicing apparatus and a second wellbore servicing apparatus, wherein the first wellbore servicing apparatus is up-hole relative to the second wellbore servicing apparatus, each of the first wellbore servicing apparatus and the second wellbore servicing apparatus comprising:

a housing substantially defining an axial flowbore; and one or more ports, each of the first wellbore servicing apparatus and the second wellbore servicing apparatus being transitional from a first mode to a second mode and from the second mode to a third mode;

transitioning the first wellbore servicing apparatus from the first mode to the second mode, wherein transitioning the first wellbore servicing apparatus from the first mode to the second mode comprises introducing an obturating member into the casing string and forward-circulating the obturating member to engage and be retained by a seat within the first wellbore servicing apparatus;

communicating a wellbore servicing fluid from the axial flowbore of the first wellbore servicing apparatus to an exterior of the housing of the first wellbore servicing apparatus via the one or more ports of the first wellbore servicing apparatus, wherein the wellbore servicing fluid is not communicated via the one or more ports of the second wellbore servicing apparatus;

transitioning the second wellbore servicing apparatus from the first mode to the second mode, wherein transitioning the second wellbore servicing apparatus from the first mode to the second mode comprises forward-circulating the obturating member to engage a seat within the second wellbore servicing apparatus;

communicating the wellbore servicing fluid from the axial flowbore of the second wellbore servicing apparatus to an exterior of the housing of the second wellbore servicing apparatus via the one or more ports of the second wellbore servicing apparatus, wherein the wellbore servicing fluid is not communicated via the one or more ports of the first wellbore servicing apparatus.

Embodiment O

The process for servicing a wellbore of embodiment N, further comprising, after communicating the wellbore servicing fluid via the one or more ports of the first wellbore servicing apparatus, allowing the first wellbore servicing apparatus to transition from the second mode to the third mode.

Embodiment P

The process for servicing a wellbore of embodiment O, wherein allowing the first wellbore servicing apparatus to transition from the second mode to the third mode comprises allowing a fluid pressure applied to the axial flowbore of the first wellbore servicing apparatus to decrease.

Embodiment Q

The process for servicing a wellbore of one of embodiments O through P, wherein allowing the first wellbore servicing apparatus to transition from the second mode to the third mode allows the obturating member to disengage the seat within the first wellbore servicing apparatus.

Embodiment R

The process for servicing a wellbore of one of embodiments O through Q, wherein allowing the first wellbore servicing apparatus to transition from the second mode to the third mode allows the obturating member to be forward-circulated to engage the seat within the second wellbore servicing apparatus.

Embodiment S

The process for servicing a wellbore of one of embodiments O through R, further comprising:

after communicating the wellbore servicing fluid via the one or more ports of the second wellbore servicing apparatus, allowing the second wellbore servicing apparatus to transition from the second mode to the third mode;

transitioning a third wellbore servicing apparatus from the first mode to the second mode, wherein the third wellbore servicing apparatus comprises:

a housing substantially defining an axial flowbore; and one or more ports, the third wellbore servicing apparatus being transitional from a first mode to a second mode and from the second mode to a third mode;

wherein transitioning the third wellbore servicing apparatus from the first mode to the second mode comprises forward-circulating the obturating member to engage a seat within the third wellbore servicing apparatus; and communicating the wellbore servicing fluid from the axial flowbore of the third wellbore servicing apparatus to an exterior of the housing of the third wellbore servicing apparatus via the one or more ports of the third wellbore servicing apparatus.

Embodiment T

The process for servicing a wellbore of one of embodiments N through S, wherein the wellbore servicing fluid comprises a fracturing fluid, a perforating fluid, an acidizing fluid, or combinations thereof.

Embodiment U

The process for servicing a wellbore of one of embodiments N through T, further comprising transitioning the first wellbore servicing apparatus, the second wellbore servicing apparatus, or both from the third mode to a fourth mode in which fluid communication is permitted between the exterior of either the first wellbore servicing apparatus or the second wellbore servicing apparatus and the axial flowbore thereof.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore servicing apparatus comprising:

a housing substantially defining an axial flowbore and comprising one or more ports, wherein the housing further comprises an expandable seat recess;

an expandable seat; and a sliding sleeve slidably fitted within the housing, the sliding sleeve being transitional from a first position relative to the housing to a second position relative to the housing and from the second position to a third position relative to the housing, wherein, in the first position, the sliding sleeve does not permit fluid communication from the axial flowbore to an exterior of the housing via the one or more ports and the expandable seat is retained in a narrower, non-expanded conformation, wherein, in the second position, the sliding sleeve is downward relative to when in the first position, the sliding sleeve permits fluid communication from the axial flowbore to the exterior of the housing via the one or more ports, and the expandable seat is retained in a narrower, non-expanded conformation, and wherein, in the third position, the sliding sleeve is upward relative to when in the second position, the sliding sleeve does not permit fluid communication from the axial flowbore to the exterior of the housing via the one or more ports, and the expandable seat is allowed to expand into a wider, expanded conformation.

2. The wellbore servicing apparatus of claim 1, wherein the expandable seat is configured to engage an obturating member.

3. The wellbore servicing apparatus of claim 1, wherein the housing further comprises a sliding sleeve recess and wherein the sliding sleeve is slidably fitted within the sliding sleeve recess of the housing.

4. The wellbore servicing apparatus of claim 3, wherein the sliding sleeve recess is substantially defined by a first collar, a second collar, and an inner bore surface of the housing.

5. The wellbore servicing apparatus of claim 4, wherein the first collar, the second collar, or both are removable from housing.

6. The wellbore servicing apparatus of claim 4, wherein the first collar, the second collar, or both are retained within the housing by shear-pins.

7. The wellbore servicing apparatus of claim 1, wherein the expandable seat is incorporated within the sliding sleeve.

8. The wellbore servicing apparatus of claim 1, wherein the expandable seat recess is characterized as having a diameter greater than a diameter of an inner bore surface of the housing.

9. The wellbore servicing apparatus of claim 1, further comprising a biasing member, wherein, when the sliding sleeve is in the first position, the biasing member is partially compressed, wherein, when the sliding sleeve is in the second position, the biasing member is more compressed relative to when the sliding sleeve is in the first position, and wherein, when the sliding sleeve is in the third position, the biasing member is less compressed relative to when the sliding sleeve is in either the first position or the second position.

10. The wellbore servicing apparatus of claim 1, further comprising a biasing member configured to bias the sliding sleeve in the direction of the third position.

11. A wellbore servicing system comprising a casing string having incorporated therein a first wellbore servicing apparatus and a second wellbore servicing apparatus, each of the first wellbore servicing apparatus and the second wellbore servicing apparatus comprising:

a housing substantially defining an axial flowbore and comprising a one or more ports, wherein the housing further comprises an expandable seat recess;

a expandable seat; and a sliding sleeve slidably fitted within the housing, the sliding sleeve being transitional from a first position relative to the housing to a second position relative to the housing and from the second position to a third position relative to the housing, wherein, in the first position, the sliding sleeve does not permit fluid communication from the axial flowbore to an exterior of the housing via the one or more pods and the expandable seat is retained in a narrower, non-expanded conformation, wherein, in the second position, the sliding sleeve is downward relative to when in the first position, the sliding sleeve permits fluid communication from the axial flowbore to the exterior of the housing via the one or more ports, and the expandable seat is retained in a narrower, non-expanded conformation, and wherein, in the third position, the sliding sleeve is upward relative to when in the second position, the sliding sleeve does not permit fluid communication from the axial flowbore to the exterior of the housing via the one or more ports, and the expandable seat is allowed to expand into a wider, expanded conformation.

12. The wellbore servicing apparatus of claim 11, wherein the first wellbore servicing apparatus is up-hole relative to the second wellbore servicing apparatus.

13. The wellbore servicing system of claim 12, herein the expandable seat of the first wellbore servicing apparatus and the expandable seat of the second wellbore servicing apparatus are configured to engage an obturating member of the same size and configuration.

14. The wellbore servicing system of claim 11, wherein each of the first wellbore servicing apparatus and the second wellbore servicing apparatus further comprises a biasing member, wherein, when the sliding sleeve is in the first position, the biasing member is partially compressed, wherein, when the sliding sleeve is in the second position, the biasing member is more compressed relative to when the sliding sleeve is in the first position, and wherein, when the sliding sleeve is in the third position, the biasing member is less compressed relative to when the sliding sleeve is in either the first position or the second position.

15. The wellbore servicing system of claim 11, wherein each of the first wellbore servicing apparatus and the second wellbore servicing apparatus further comprises a biasing member configured to bias the sliding sleeve in the direction of the third position.

16. A process for servicing a wellbore comprising:

positioning a casing string within the wellbore, the casing string having incorporated therein a first wellbore servicing apparatus and a second wellbore servicing apparatus, wherein the first wellbore servicing apparatus is up-hole relative to the second wellbore servicing apparatus, each of the first wellbore servicing apparatus and the second wellbore servicing apparatus comprising:

a housing substantially defining an axial flowbore; and one or more ports, each of the first wellbore servicing apparatus and the second wellbore servicing apparatus being transitional from a first mode to a second mode and from the second mode to a third mode;

transitioning the first wellbore servicing apparatus from the first mode to the second mode, wherein transitioning the first wellbore servicing apparatus from the first mode to the second mode comprises introducing an obturating member into the casing string and forward-circulating the obturating member to engage and be retained by a seat within the first wellbore servicing apparatus;

communicating a wellbore servicing fluid from the axial flowbore of the first wellbore servicing apparatus to an exterior of the housing of the first wellbore servicing apparatus via the one or more ports of the first wellbore servicing apparatus, wherein the wellbore servicing fluid is not communicated via the one or more ports of the second wellbore servicing apparatus;

transitioning the second wellbore servicing apparatus from the first mode to the second mode, wherein transitioning the second wellbore servicing apparatus from the first mode to the second mode comprises forward-circulating the obturating member to engage a seat within the second wellbore servicing apparatus;

communicating the wellbore servicing fluid from the axial flowbore of the second wellbore servicing apparatus to an exterior of the housing of the second wellbore servicing apparatus via the one or more ports of the second wellbore servicing apparatus, wherein the wellbore servicing fluid is not communicated via the one or more ports of the first wellbore servicing apparatus, and further comprising transitioning the first wellbore servicing apparatus, the second wellbore servicing apparatus, or both from the third mode to a fourth mode in which fluid communication is permitted between the exterior of either the first wellbore servicing apparatus or the second wellbore servicing apparatus and the axial flowbore thereof.

17. The process for servicing a wellbore of claim 16, further comprising, after communicating the wellbore servicing fluid via the one of more ports of the first wellbore servicing apparatus, allowing the first wellbore servicing apparatus to transition from the second mode to the third mode.

18. The process for servicing a wellbore of claim 17, wherein allowing the first wellbore servicing apparatus to transition from the second mode to the third mode comprises allowing a fluid pressure applied to the axial flowbore of the first wellbore servicing apparatus to decrease.

19. The process for servicing a wellbore of claim 17, wherein allowing the first wellbore servicing apparatus to transition from the second mode to the third mode allows the obturating member to disengage the seat within the first wellbore servicing apparatus.

20. The process for servicing a wellbore of claim 19, wherein allowing the first wellbore servicing apparatus to transition from the second mode to the third mode allows the obturating member to be forward-circulated to engage the seat within the second wellbore servicing apparatus.

21. The process for servicing a wellbore of claim 17, further comprising:

after communicating the wellbore servicing fluid via the one or more ports of the second wellbore servicing apparatus, allowing the second wellbore servicing apparatus to transition from the second mode to the third mode;

transitioning a third wellbore servicing apparatus from the first mode to the second mode, wherein the third wellbore servicing apparatus comprises:

a housing substantially defining an axial flowbore; and one or more ports, the third wellbore servicing apparatus being transitional from a first mode to a second mode and from the second mode to a third mode;

wherein transitioning the third wellbore servicing apparatus from the first mode to the second mode comprises forward-circulating the obturating member to engage a seat within the third wellbore servicing apparatus; and communicating the wellbore servicing fluid from the axial flowbore of the third wellbore servicing apparatus to an exterior of the housing of the third wellbore servicing apparatus via the one or more ports of the third wellbore servicing apparatus.

22. The process for servicing a wellbore of claim 16, wherein the wellbore servicing fluid comprises a fracturing fluid, a perforating fluid, an acidizing fluid, or combinations thereof.

23. A wellbore servicing apparatus comprising:

a housing substantially defining an axial flowbore and comprising one or more ports, wherein the housing further comprises an expandable seat recess and a sliding sleeve recess, wherein the sliding sleeve recess is substantially defined by a first collar, a second collar, and an inner bore surface of the housing, wherein the first collar, the second collar, or both are retained within the housing by shear-pins;

an expandable seat; and a sliding sleeve slidably fitted within the housing, the sliding sleeve being transitional from a first position relative to the housing to a second position relative to the housing and from the second position to a third position relative to the housing, and wherein the sliding sleeve is slidably fitted within the sliding sleeve recess of the housing, wherein, in the first position, the sliding sleeve does not permit fluid communication from the axial flowbore to an exterior of the housing via the one or more ports and the expandable seat is retained in a narrower, non-expanded conformation, wherein, in the second position, the sliding sleeve permits fluid communication from the axial flowbore to the exterior of the housing via the one or more ports and the expandable seat is retained in a narrower, non-expanded conformation, and wherein, in the third position, the sliding sleeve does not permit fluid communication from the axial flowbore to the exterior of the housing via the one or more ports and the expandable seat is allowed to expand into a wider, expanded conformation.

24. A wellbore servicing apparatus comprising:

a housing substantially defining an axial flowbore and comprising one or more ports, wherein the housing further comprises an expandable seat recess;

an expandable seat;

a sliding sleeve slidably fitted within the housing, the sliding sleeve being transitional from a first position relative to the housing to a second position relative to the housing and from the second position to a third position relative to the housing, wherein, in the first position, the sliding sleeve does not permit fluid communication from the axial flowbore to an exterior of the housing via the one or more ports and the expandable seat is retained in a narrower, non-expanded conformation, wherein, in the second position, the sliding sleeve permits fluid communication from the axial flowbore to the exterior of the housing via the one or more ports and the expandable seat is retained in a narrower, non-expanded conformation, and wherein, in the third position, the sliding sleeve does not permit fluid communication from the axial flowbore to the exterior of the housing via the one or more ports and the expandable seat is allowed to expand into a wider, expanded conformation; and a biasing member, wherein, when the sliding sleeve is in the first position, the biasing member is partially compressed, wherein, when the sliding sleeve is in the second position, the biasing member is more compressed relative to when the sliding sleeve is in the first position, and wherein, when the sliding sleeve is in the third position, the biasing member is less compressed relative to when the sliding sleeve is in either the first position or the second position.

25. A wellbore servicing system comprising a casing string having incorporated therein a first wellbore servicing apparatus and a second wellbore servicing apparatus, wherein the first wellbore servicing apparatus is up-hole relative to the second wellbore servicing apparatus, and wherein each of the first wellbore servicing apparatus and the second wellbore servicing apparatus comprises:

a housing substantially defining an axial flowbore and comprising a one or more ports, wherein the housing further comprises an expandable seat recess;

an expandable seat, wherein the expandable seat of the first wellbore servicing apparatus and the expandable seat of the second wellbore icing apparatus are configured to engage an obturating member of the same size and configuration; and a sliding sleeve slidably fitted within the housing, the sliding sleeve being transitional from a first position relative to the housing to a second position relative to the housing and from the second position to a third position relative to the housing, wherein, in the first position, the sliding sleeve does not permit fluid communication from the axial flowbore to an exterior of the housing via the one or more ports and the expandable seat is retained in a narrower, non-expanded conformation, wherein, in the second position, the sliding sleeve permits fluid communication from the axial flowbore to the exterior of the housing via the one or more ports and the expandable seat is retained in a narrower, non-expanded conformation, and wherein, in the third position, the sliding sleeve does not permit fluid communication from the axial flowbore to the exterior of the housing via the one or more ports and the expandable seat is allowed to expand into a wider, expanded conformation.

* * * * *

UNITED STATES PATENT AND TRADEMARK OFFICE

CERTIFICATE OF CORRECTION

PATENT NO. : 8,662,178 B2
APPLICATION NO. : 13/248145
DATED : March 4, 2014
INVENTOR(S) : William Mark Norrid et al.

It is certified that error appears in the above-identified patent and that said Letters Patent is hereby corrected as shown below:

In the Claims:

In Column 24, Claim 11, line 27, replace “more pods” with --more ports--.

In Column 24, Claim 13, line 45, replace “herein the” with --wherein the--.

In Column 28, Claim 25, line 10, replace “wellbore icing” with --wellbore servicing--.

Signed and Sealed this
Twenty-seventh Day of May, 2014

Michelle K. Lee

Michelle K. Lee
*Deputy Director of the United States Patent and Trademark Office*